US012774824B2

(12) United States Patent
Hiroishi et al.

(10) Patent No.: US 12,774,824 B2
(45) Date of Patent: Oct. 27, 2026

(54) DUCT TYPE AIR CONDITIONING VENTILATION SYSTEM

(71) Applicant: FH alliance Inc., Kasugai (JP)

(72) Inventors: Kazuro Hiroishi, Kasugai (JP); Mitsunori Matsubara, Kasugai (JP)

(73) Assignee: FH ALLIANCE INC., Kasugai (JP)

( * ) Notice: Subject to any disclaimer, the term of this patent is extended or adjusted under 35 U.S.C. 154(b) by 389 days.

(21) Appl. No.: 18/569,935

(22) PCT Filed: May 13, 2022

(86) PCT No.: PCT/JP2022/020144
§ 371 (c)(1),
(2) Date: Dec. 13, 2023

(87) PCT Pub. No.: WO2022/264721
PCT Pub. Date: Dec. 22, 2022

(65) Prior Publication Data

US 2024/0280281 A1 Aug. 22, 2024

(30) Foreign Application Priority Data

Jun. 14, 2021 (JP) ..... 2021-098771

(51) Int. Cl.
*F24F 7/08* (2006.01)
*F24F 11/00* (2018.01)
(Continued)

(52) U.S. Cl.
CPC ..... *F24F 7/08* (2013.01); *F24F 11/0001* (2013.01); *F24F 13/28* (2013.01); *F24F 2110/10* (2018.01)

(58) Field of Classification Search
CPC ..... F24F 7/08; F24F 11/0001; F24F 13/28; F24F 2110/10
(Continued)

(56) References Cited

U.S. PATENT DOCUMENTS 7,758,407 B2 * 7/2010 Ahmed ..... F24F 11/30 700/277
8,364,318 B2 * 1/2013 Grabinger ..... F24F 11/77 454/333
(Continued)

FOREIGN PATENT DOCUMENTS

JP S53-121657 U 9/1978
JP H01-269852 A 10/1989
(Continued)

OTHER PUBLICATIONS

Office Action of corresponding Japanese Patent Application No. 2025-003859: Notice of Reasons for Rejection issued Nov. 18, 2025 (3 sheets, 8 sheets translation, 11 sheets total).
Office Action of corresponding Japanese Patent Application No. 2021-098771: Notice of Reasons for Rejection dated Oct. 14, 2021 (2 sheets, 5 sheets translation).
International Search Report for International Application No. PCT/JP2022/020144 dated Jul. 26, 2022 (3 sheets).

*Primary Examiner* — Avinash A Savani
*Assistant Examiner* — Dana K Tighe
(74) *Attorney, Agent, or Firm* — Kratz, Quintos & Hanson, LLP

(57) ABSTRACT

[Object] It is an object of the present invention to provide a duct type air conditioning ventilation system in which harmful materials such as dust, mold and bad smell do not are not attached to deposited on the air conditioning duct, and maintenance such as exchanging and cleaning of the duct is unnecessary even if the system is continuously operated for a long term.
[Solving Means] Air sucked from a suction portion 44 through a circulation passage is cleaned by a filter portion A, a portion of the sucked air is air-conditioned and cleaned by an air conditioning portion 16 and a filter portion B, blown-out air which is blown out from the air conditioning portion 16 and a remaining portion of the portion of the sucked air are mixed by a plurality of air-blowing portions 13 in a mixing portion 85, conditioned air within about 5 K at the time of the cooling operation and within about 10 K at the
(Continued)

time of the heating operation is further cleaned by the plurality of air-blowing portions 13 with respect to temperature of air around the air conditioning ducts 30, 31, 32, 33 and 34, and the air is sent into the air conditioning ducts 30, 31, 32, 33 and 34 toward the outlet, thereby air-conditioning and air-cleaning in a room 20, 21 and a heat resistant space, the outdoor air introduction passage is provided with an introduction fan and a filter, introduced outdoor air is cleaned, the indoor air exhausting passage is provided with an exhaust fan, and at least one of a portion of air in the circulation passage and a portion of air accumulated in a building 2 is discharged to outdoor.

7 Claims, 7 Drawing Sheets

(51) Int. Cl.
*F24F 13/28* (2006.01)
*F24F 110/10* (2018.01)

(58) Field of Classification Search
USPC ..... 454/237
See application file for complete search history.

(56) References Cited

U.S. PATENT DOCUMENTS

| | | | | |
|---|---|---|---|---|
| 10,928,092 | B2 * | 2/2021 | Yajima | F24F 11/89 |
| 2006/0117769 | A1 * | 6/2006 | Helt | F24F 11/46 236/49.3 |
| 2019/0145642 | A1 * | 5/2019 | Heigl | F24F 13/10 454/239 |
| 2020/0292198 | A1 * | 9/2020 | Funada | F24F 3/001 |

FOREIGN PATENT DOCUMENTS

| | | | |
|---|---|---|---|
| JP | H11-287362 | A | 10/1999 |
| JP | 2009-121793 | A | 6/2009 |
| JP | 2011-174674 | A | 9/2011 |
| JP | 2012-154623 | A | 8/2012 |
| JP | 2017-150704 | A | 8/2017 |
| JP | 2017-198395 | A | 11/2017 |
| JP | 2019-039611 | A | 3/2019 |
| JP | 2019-105383 | A | 6/2019 |
| JP | 2020-204466 | A | 12/2020 |
| WO | 2020/066320 | A1 | 4/2020 |

* cited by examiner

[Fig. 1]
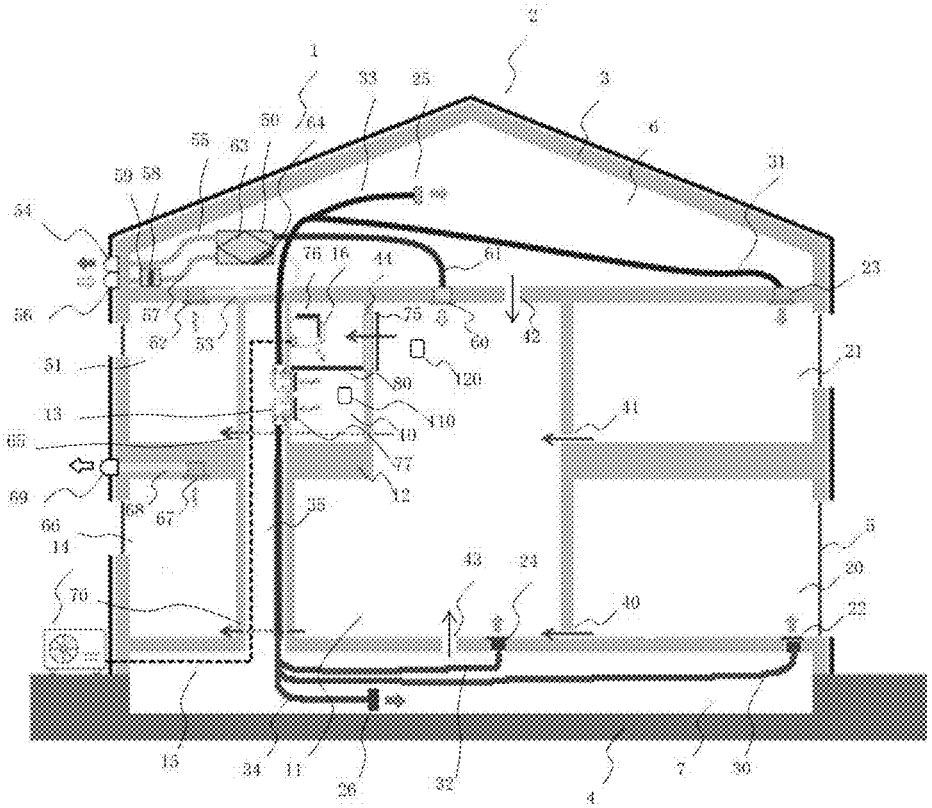

[Fig. 2]
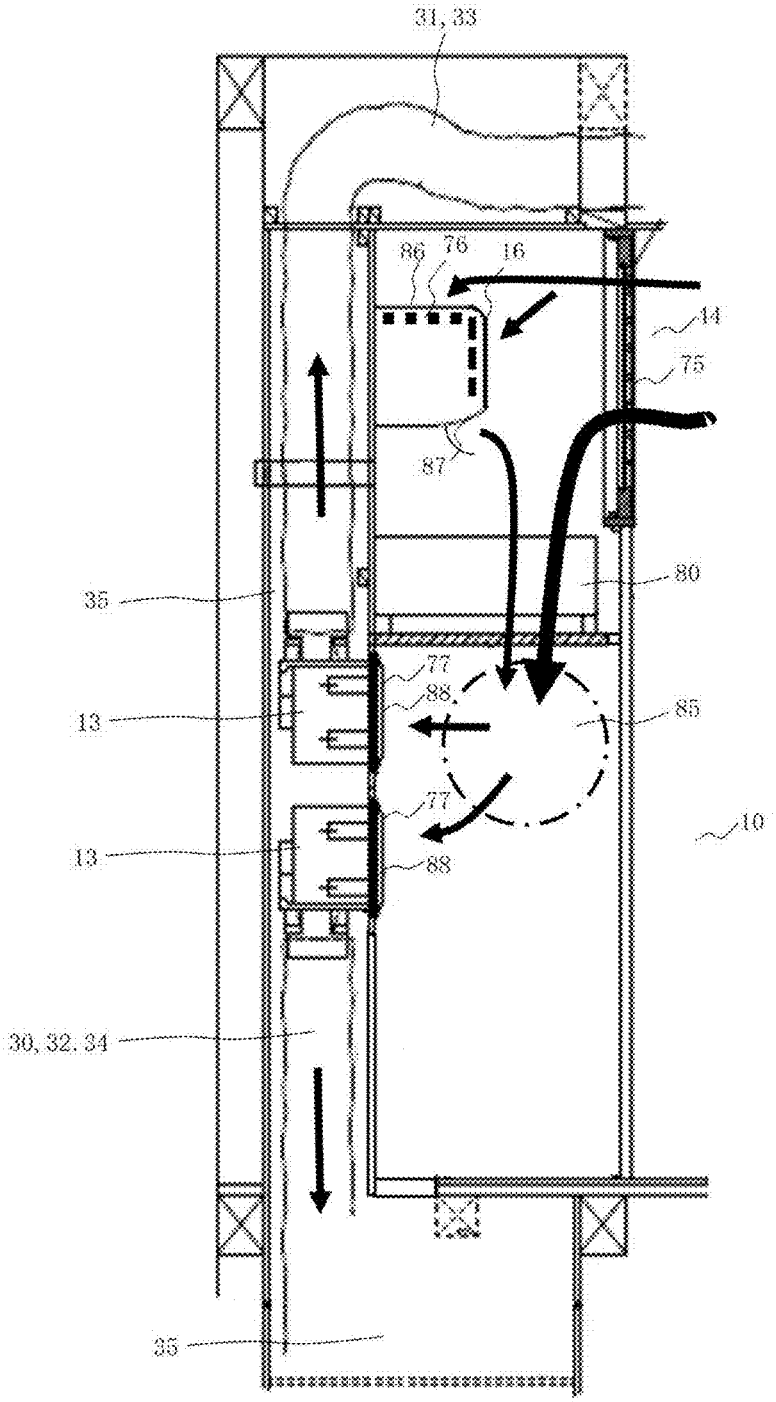

[Fig. 3]
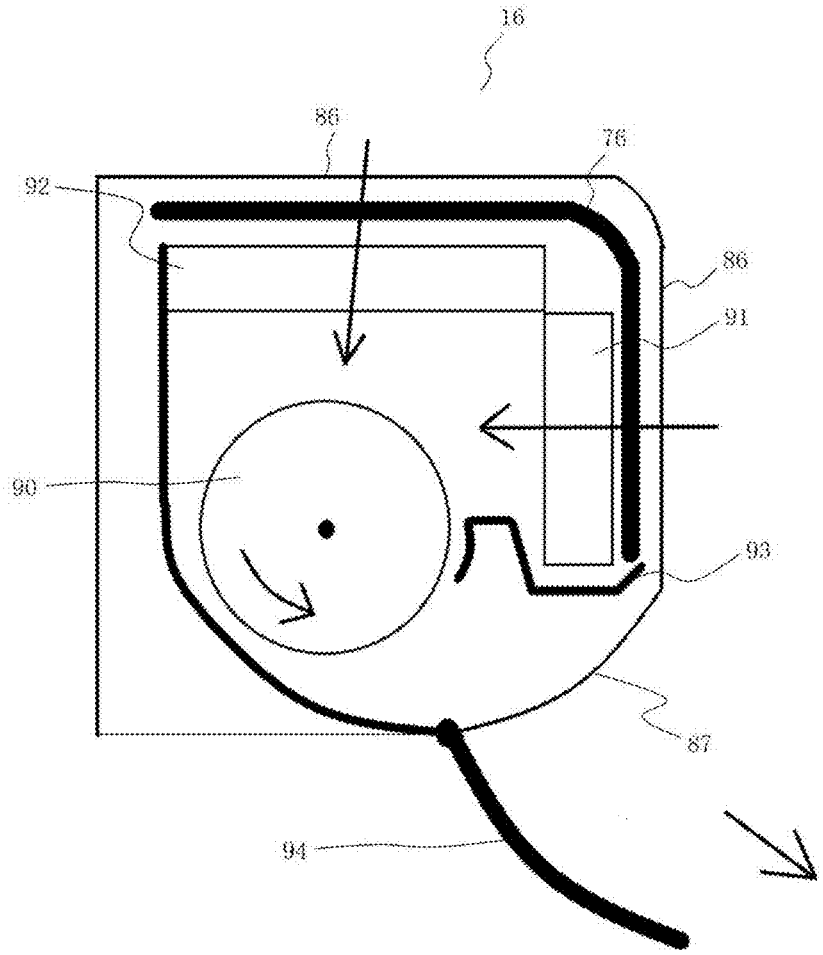

[Fig. 4]
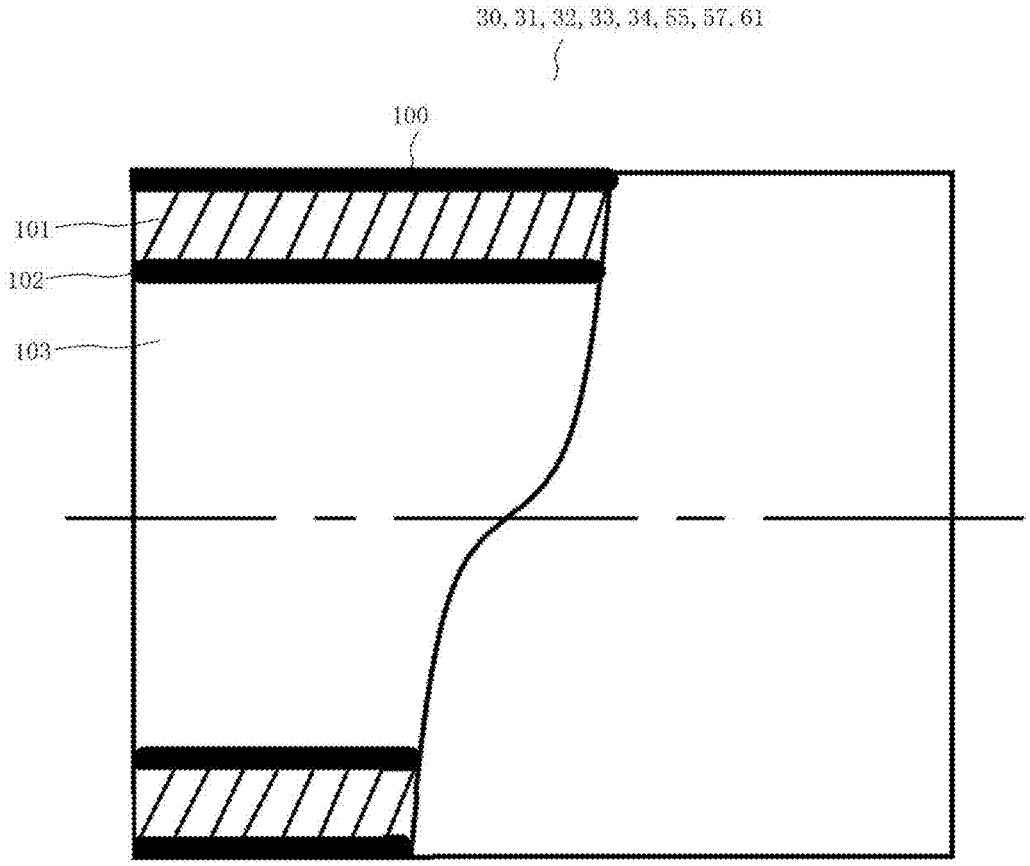

[Fig. 5]
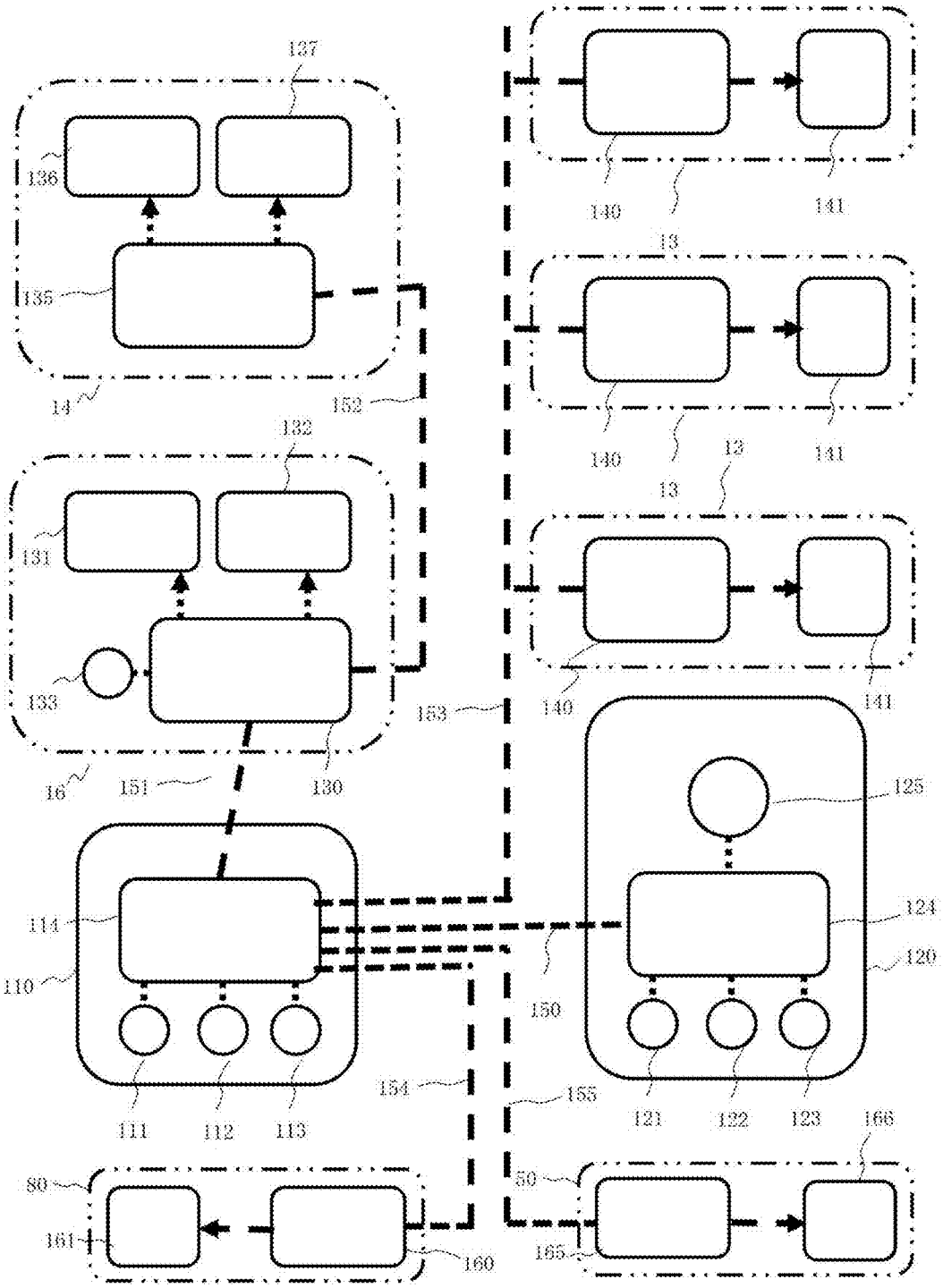

[Fig. 6]
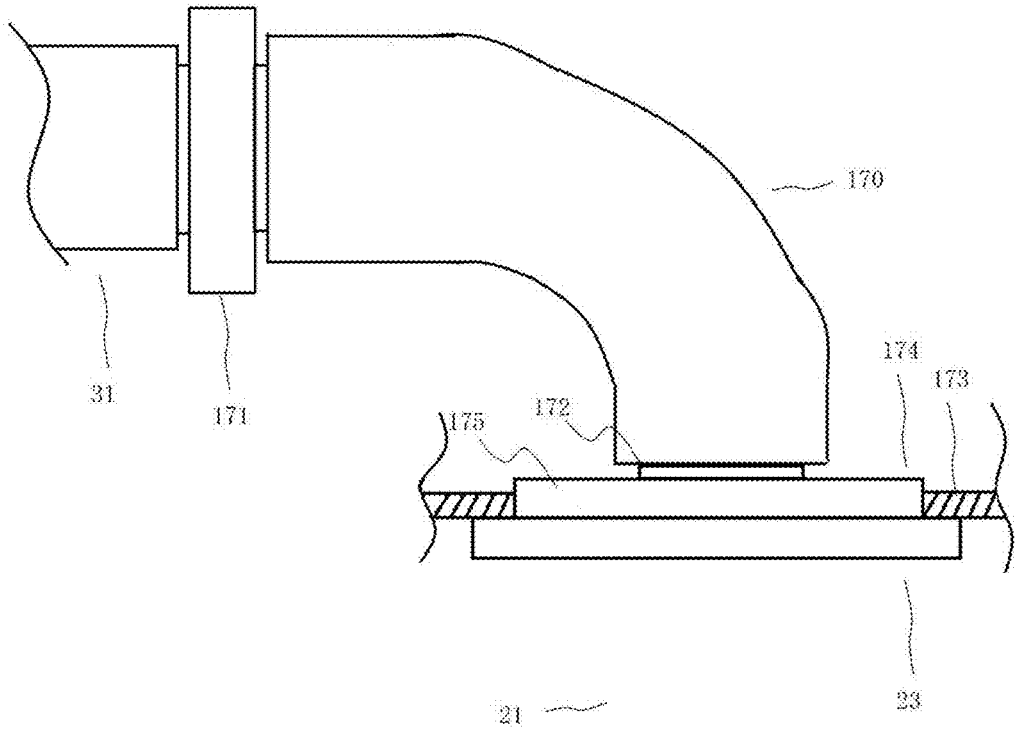

[Fig. 7]
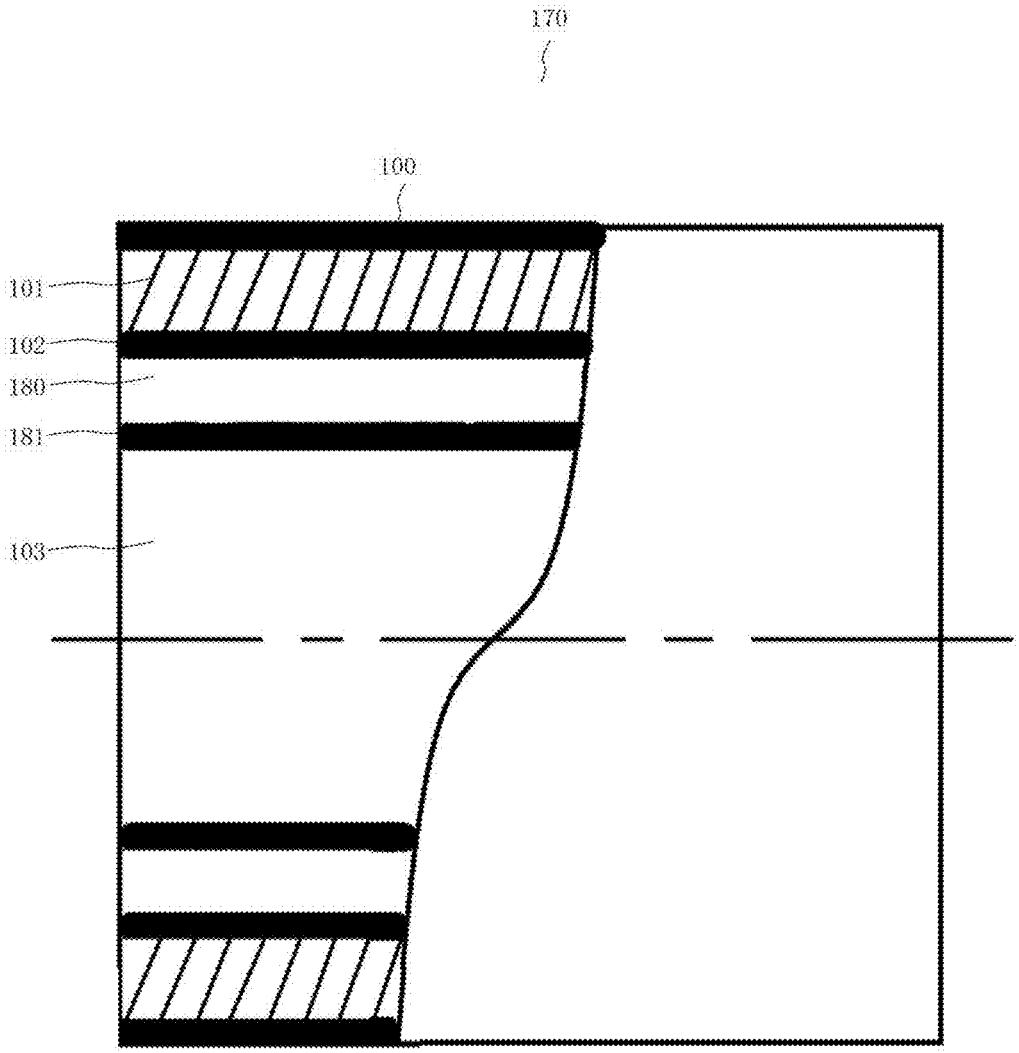

DUCT TYPE AIR CONDITIONING VENTILATION SYSTEM

TECHNICAL FIELD

The present invention relates to a duct type air conditioning ventilation system for air conditioning and ventilating in a building through a duct.

BACKGROUND TECHNIQUE

For realizing energy-saved and comfortable living in a building, airtight performance and thermal insulation are increasingly progressing. In such dwelling and non-dwelling, duct type air conditioning ventilation systems are relatively widely employed for spreading dusts for all over sending conditioning air and ventilated air into a room and a space of a building from an air conditioner and for entirely air conditioning and ventilating the building.

According to the duct type air conditioning ventilation system, since the conditioned air and ventilated air are sent into a room and the like through a duct, if the duct type air conditioning ventilation system is used for a long time, dust inside and outside of the building, house dust, person's dandruff or dandruff of a ped, mite or excrement of thereof or remain thereof, VOC, allergen such as mold are deposited in the dust.

Especially in the duct, propagation conditions of mold such as "temperature around 5 to 40° C.", "moisture attached due to high humidity of 60% or higher" and "nutrients such as attached dust and dirty" are satisfied, dew is condensed on the dust deposited in the duct, non-woven fabric of the duct or the insulator material due to a temperature difference between inside and outside of the duct, and mold and mite are easily propagated.

If the conditioned air passes therethrough, dust, mold, bacteria, unusual smell or the like in the conditioned air, and if a person breathes the air and develops disease of a respiratory system or allergy such as skill trouble, and there is a risk that the person injures or his or her health and becomes unpleasant.

Further, when heat resistant properties of the duct is poor and the duct does not pass through a heat resistant space, condensation occurs also on an outer periphery of the duct, woods under the duct are wet, a mold is generated, a mottled mark appears from a living space, the woods become rotten and the woods str damaged in terms of intensity, condensation is transmitted to an electric wire and there is a risk that electric leakage occurs.

In the case of glass wool of the heat resistant material in the duct, if moisture enters clearances of fibers by surface tension or capillary action of the glass wool, even if the moisture dries, the fibers stick together, a large amount of air which is required for heat resistant function cannot be accumulated, and the heat resistant function is deteriorated. Therefore, the condensation once occurs in the duct, the condensation easily occurs more than ever, air conditioning effect is deteriorated, and consumed power increases.

Concerning the condensation, cold outlet air when a thermo is turned ON where a compressor of an air conditioner is operated during cooling operation passes through the duct. Therefore, an inner periphery surface of the duct is cooled. If the thermo is turned OFF in a state where temperature of the inner periphery surface is 10° C. for example and the compressor stops and indoor air is sucked, and if outlet air includes condensed water which occurs condensation in the evaporator at the indoor air temperature passes through the duct, and the humidity of the inner periphery surface becomes high passes through the duct. When temperature and humidity of the air is 25° C. and 80% (dew-point temperature is 21° C.), condensation occurs on the inner periphery surface of the duct.

When the duct does not pass through a heat resistant space in a house and heat resistant properties of the duct are low, temperature and humidity of the space is close to outside air temperature in summer. For example, suppose that outside air temperature is 35° C., room temperature is 30° C. and relative humidity is 50% (dew-point temperature is 4° C.), cold outlet air passes through the duct by the cooling operation, and the outer periphery surface temperature of the duct becomes equal to or lower than the dew-point temperature. Under these conditions, condensation occurs on the outer periphery surface of the duct.

Further, in winter, suppose that in a state where temperature of that space is close to the outside air temperature and outside air temperature is 0° C. and room temperature is 2° C. for example, and warm outlet air when the thermo operated by the compressor is ON by the heating operation (temperature and humidity are 50° C. and 11% (dew-point temperature is 12° C.) passes through the duct and inner periphery surface temperature of the duct becomes equal to or lower than the dew-point temperature. Under these conditions, condensation occurs on the inner periphery surface of the duct. Further, suppose that the thermo is turned OFF, the compressor is stopped, indoor air is sucked and the temperature and humidity of indoor air passes through the duct. Under these conditions, if temperature and humidity of this air become 20° C. and 60% (dew-point temperature is 12° C.), the inner periphery surface temperature of the duct becomes equal to or lower than the dew-point temperature, condensation occurs on the inner periphery surface of the duct. In winter, if the room is humidified by a humidifier to prevent overdrying, condensation is further prone to occur.

Hence, it is necessary to periodically exchange the duct and to clean inside of the duct, but usually, an exchanging space and a maintenance space are narrow and it is necessary to remove a wall around the duct, but it is difficult to check where the duct is placed or installed. Further, even if attempt is made to clean the duct, it is not possible to sufficiently clean the duct due to a shape and a structure of the duct, and if there exists non-woven fabric on the interior surface for example, dust, mite, mold and the like attached to the non-woven fabric or the like, they cannot be removed even by a dedicated cleaning machine, and there is a risk that the non-woven fabric is damaged. Therefore, even if the duct could be cleaned or exchanged, it is necessary to spend large time and cost. Further, if the duct is placed or installed prepared in a building to secure the exchanging space, a living space is largely reduced.

Conventionally, there is a known air conveying type air conditioner into each room which includes an attic of a chamber structure provided with airtight, a plurality of indoor-side discharge ports which bring the attic and the room into communication with each other, a box-shaped body having an attic outlet and the indoor-side suction ports which are in communication with the attic, an air blower provided such that the air blower sucks air into this body from the indoor-side suction port and blasts out from a ceiling outlet, and a cooling heat exchanger and a heating heat exchanger which are provided in a ventilation passage formed by the air blower, the wind passage surfaces are arranged on substantially the same plan such that the ventilation passage of the cooling heat exchanger and the heating heat exchanger is divided into two, indoor air is directly sucked into a heating heat exchanger which reheats, latent heat ability is increased by flowing a small air volume, and in order to blow dry cold air and cold wind in which sensible heat ability is increased to the attic, even when there is beam in the attic or when the attic itself is narrow, air can reliably be conditioned by conveying air into each room without occurring the condensation (see patent document 1 for example).

As an entire-house air conditioning system which sends conditioned air to rooms through the air supply duct, there is a known air conditioning system which includes a temperature adjusting portion for adjusting temperature of air which is sent to the rooms through the air supply duct, a humidity detecting portion for measuring humidity of the air which flows into the air supply duct, and a control portion. When a signal for tuning the temperature adjusting portion OFF is detected, the control portion continues the ON state of the temperature adjusting portion if humidity measured by the humidity detecting portion is higher than a predetermined value, and the control unit turns the temperature adjusting portion OFF if the humidity measured by the humidity detecting portion is smaller than the predetermined value. The known air conveying type air conditioner can suppress the generation of condensation in an inner surface of the air supply duct when a heating operation is carried out in winter (see patent document 2 for example).

Further, there is a known duct air conditioning system including a suction chamber having an air-suction port which opens into an exterior space of a living room which is subjected to air-conditioning, an indoor unit having a heat exchanger for cooling or heating air which is sucked through the suction chamber, and an air duct for conveying air which is cooled or heated by the indoor unit to the air outlet of the living room. The duct air conditioning system also includes a reheating coil which is placed downstream of the heat exchanger and which heats dehumidified air cooled by the heat exchanger at the time of the cooling operation. According to this, it is possible to know whether the duct member of the air duct is covered with heat resistant material, or it is possible to know that the duct member is covered with thin heat resistant material (see patent document 3 for example).

As an air blowing duct and an air blowing system for carrying out a ventilating operation and cooling and heating operations in a house, there are known duct and system in which a coating cover including charcoal power is formed on an inner surface of a duct, an inlet and an outlet of air and an air outlet device are connected to each other through the duct, thereby composing the air blowing system of a house, generation of mold and bad smell in the duct caused by charcoal powder is restrained, smell included in air can be removed, and comfortable housing environment can be obtained (see patent document 4 for example).

PRIOR ART DOCUMENTS

Patent Documents

[Patent Document 1] Japanese Patent Application Laid-open No. H11-237079

[Patent Document 2] Japanese Patent No. 6712763

[Patent Document 3] Japanese Utility Model Application Laid-open No. H7-18129

[Patent Document 4] Japanese Patent Application Laid-open No. 2001-248886

SUMMARY OF THE INVENTION

Problem to be Solved by the Invention

However, in the air conveying type air conditioner described in patent document 1, since it is not possible to flow the conditioned air to a place other than the attic, it is not possible to cope with the problem due to a structure of building in many cases. And even if it is possible to cope with the problem, since air is conditioned using air having deteriorated sensible heat ability, when an air conditioning load is increased if the air conditioner starts operating or due to outside air temperature, there is a problem that temperature and humidity are not stabilized or it takes time until the temperature and humidity are stabilized because the sensible heat ability is insufficient.

The entire-house air conditioning system described in patent document 2 has a problem that in order to prevent condensation of an air supply duct or the like, it is necessary to control the humidity with a complicating program using dedicated controller and sensor and therefore, initial cost is expensive, and there is a possibility that condensation occurs in the duct if a cooling thermo is turned OFF at the time of the cooling operation when temperature and humidity are high in summer.

In the duct air conditioning system described in patent document 3, since the air conditioning is carried out using air having deteriorated sensible heat ability, when an air conditioning load is increased if the air conditioner starts operating or due to outside air temperature, there is a problem that temperature and humidity are not stabilized or it takes time until the temperature and humidity are stabilized because the sensible heat ability is insufficient.

In the air blowing duct and the air blowing system described in document 4, there is a problem that when dust or bacteria is deposited on a surface of coating cover including charcoal power in the duct and condensation occurs, it is not possible to prevent the propagation of mold or the like.

The present inventors developed a duct type air conditioning ventilation system in which harmful materials such as dust, mold and bad smell were less prone to be attached or deposited in and on the duct, and even if the system was used for a long time, maintenance such as interchanging and cleaning of ducts was unnecessary, and healthy and comfortable air conditioning and air-ventilation could always be carried out in a building.

The present invention is for solving such a conventional problem and it is an object of the invention to provide a duct type air conditioning ventilation system which is suitable for various room layout and shapes of a building, and in which the system uses versatile devices, condensation in an air conditioning duct is prevented, deposition of dust in the duct is prevented, the system satisfies variation in load such as outside air temperature while suppressing propagation of mold, air conditioning and air-ventilation in a room and a space are appropriately carried out, and the system can always realize a healthy space of energy-saved uniform temperature, high quality air, always comfortable and clean air.

Further, the system uses relatively simple device configuration, condensation in the air conditioning duct is suppressed and therefore, control delay is not generated, a controller and a sensor which are suitable for temperature which is set by a user are utilized and condensation is simultaneously prevented and therefore, it is an object of the invention to provide a duct type air conditioning ventilation system for stably realizing energy-saved comfortable and healthy space.

It is an object of the invention to provide a duct type air conditioning ventilation system in which harmful materials such as dust, mold and bad smell are less prone to be attached or deposited in the air conditioning duct even if the system is continuously operated for a long time, and maintenance such as interchanging and cleaning of ducts is unnecessary

Means for Solving the Problem

To achieve the above object, in a duct type air conditioning ventilation system of the present invention, an outlet is provided in a room and a heat resistant space in a high airtight and high heat resistant building, an air conditioning unit and the outlet provided in the building are connected to each other through an air conditioning duct, the air conditioning duct is formed in the heat resistant space, conditioned air which is cleaned by the air conditioning unit is created, the cleaned conditioned air flows from the air conditioning unit to the outlet, and a wind passage from the room and the heat resistant space where the outlet is provided and which returns to the air conditioning unit is a circulation passage, wherein a suction portion, an air conditioning portion, a mixing portion and a plurality of air-blowing portions are provided in this order in the air conditioning unit from an upstream side toward a downstream side of the circulation passage, the suction portion, the air conditioning portion and the plurality of air-blowing portions are provided with a filter portion A, a filter portion B and a filter portion C, respectively, air sucked from the suction portion through the circulation passage is cleaned by the filter portion A, a portion of the air sucked from the suction portion is air-conditioned and cleaned by the air conditioning portion and the filter portion B, blown-out air which is blown out from the air conditioning portion and a remaining portion of the portion of the air sucked from the suction portion are mixed, by the plurality of air-blowing portions, with each other in the mixing portion located upstream of the filter portion C, conditioned air within 5 K at the time of a cooling operation and within 10 K at the time of a heating operation are created with respect to temperature of air around the air conditioning duct, the conditioned air is further cleaned by the plurality of air-blowing portions and the filter portion C, the cleaned conditioned air is blown into the air conditioning duct toward the outlet, thereby air-conditioning and air-cleaning the room and the heat resistant space through the circulation passage, the air conditioning ventilation system further includes an outdoor air introduction passage for introducing outdoor air into the circulation passage or the air conditioning unit from outdoor, the outdoor air introduction passage is provided with an introduction fan and a filter, and the introduced outdoor air is cleaned, the air conditioning ventilation system further includes an indoor air exhausting passage for discharging air into the building to outdoor from any one of the circulation passage, the room which is not provided with the outlet, and the heat resistant space which is not provided with the outlet, and the indoor air exhausting passage is provided with an exhaust fan, and at least one of a portion of air in the circulation passage and a portion of the air which is accumulated in the building is discharged to outdoor.

According to this means, a large volume of conditioned air within 5 K at the time of cooling operation and within 10 K at the time of heating operation is sent into the duct for temperature of air around the air conditioning duct which is formed by the air conditioning unit. According to this, air blows out from the outlet of the room and the heat resistant space, and air is conditioned in the building, rooms, upper and lower heat resistant spaces which are high airtight and high heat resistant. Therefore, comfortable and uniform, temperature and humidity can easily be obtained in the building including a heat resistant space having a large air conditioning load such as isolation load. Since the air conditioning duct passes through the heat resistant space, and it is possible to obtain a duct type air conditioning ventilation system in which condensation inside and outside of the duct at the time of the cooling operation and condensation in the duct at the time of heating operation are less prone to be generated.

The air conditioning unit which creates conditioned air is provided with a filter portion, air in the building is cleaned, the outdoor air introduction passage is provided with an introduction fan and a filter, and the introduced outdoor air is cleaned. From an indoor air discharging passage which leads to the outdoor from a so-called dirty zone (bathroom, lavatory or the like), air of the dirty zone and a portion of air which is air-conditioned in the room and the heat resistant space is discharged to the outdoor, thereby introducing cleaned outdoor air, air in the building which is soiled with dust or moisture is discharged and, in this state, air is cleaned while circulating the air through the building. Since the cleaned air flows through the duct, it is possible to obtain a duct type air conditioning ventilation system in which dust is less prone to be deposited in the duct.

Further, air in a bathroom, a kitchen and the like where moisture is generated by bathing or cooking other than moisture generated by a human does not stay in the building by providing an exhaust fan which discharges air to outside of the room, and the air is not included in the conditioned air. Therefore, these moistures do not flow into the duct.

By these reasons, since dust, moisture, condensation water and the like are not deposited or accumulated in the air conditioning duct, mold is less prone to propagate, smell caused by miscellaneous bacteria is less prone to be generated, dust, mold, bacteria and unusual smell are less prone to enter the building, and a healthy and comfortable space can be realized. Further, even if the system is used for a long time, maintenance such as exchanging and cleaning of ducts is unnecessary, and it is possible to obtain a duct type air conditioning ventilation system capable of always carrying out healthy and comfortable air conditioning and ventilation in the building.

According to another means, the high airtight and high heat resistant building is of roof heat resistant specification and basis heat resistant specification, the heat resistant space is an attic space and an under floor space, a total air volume of the plurality of air-blowing portions is larger than that of the air conditioning portion, and the air volume of the air-blowing portion is not zero.

According to this means, a high airtight and high heat resistant building is defined as roof heat resistant specification and basic heat resistant specification, and an attic space which is the uppermost portion of the building and which is easily influenced by insolation and outdoor air temperature is defined as a heat resistant space, an under floor space which is the lowermost portion of the building and which is influence by temperature of ground surface and whose humidity is prone to become high is defined as heat resistant space, these spaces are air-conditioned, all spaces including a space facing an outer skin of the building is a heat resistant space together with air conditioning of a room which is a heat resistant space of a side of the building, and all of them are air-conditioned. Therefore, temperature and humidity in the building become more uniform including inside and outside of the air conditioning duct, and it is possible to obtain a duct type air conditioning ventilation system in which condensation inside and outside of the duct at the time of cooling operation and condensation in the duct at the time of heating operation are less prone to be generated.

A portion of air sucked from a suction portion by an air-blowing portion of the air conditioning unit is sucked into the air conditioning portion, air is conditioned and blown out. A portion of air sucked from the suction portion is not sucked into the air conditioning portion, the portion of air joins up with and is mixed with blown-out air from the air conditioning portion in the mixing portion, air volume, set temperature of the air conditioning portion and air volume of the air-blowing portion and the like are adjusted, a large volume of conditioned air within 5 K at the time of cooling operation and within 10 K at the time of heating operation can stably be created with saved energy for temperature of air around the air conditioning duct, and this air-conditioned air passes through the air conditioning duct. Therefore, it is possible to obtain a duct type air conditioning ventilation system in which condensation is less prone to be generated in the air conditioning duct.

Further, all of air sucked into the air conditioning unit is cleaned by a filter portion provided in the suction portion of the air conditioning unit, and the air flows into the air conditioning duct. Therefore, a risk of dust flowing into the air conditioning duct is further reduced, and the suction portion is provided with the filter portion and thus, it is possible to obtain a duct type air conditioning ventilation system in which maintenance such as cleaning is easily carried out.

Air volume of the air-blowing portion is largely great as compared with air volume of the air conditioning portion, and large volume of conditioned air within 5 K at the time of cooling operation and within 10 K at the time of heating operation can stably be created while saving energy, overshoot of temperature of a room and a space is not largely varied, temperature of sucked air of the air conditioning portion is stably close to set temperature for a long time. Therefore, especially when cooling operation is carried out in summer, the ON state of the thermo is continued for a long time with a small temperature difference in the air conditioning portion, and the compressor is continuously operated with low frequency. Therefore, surface temperature of the evaporator, i.e., evaporation temperature becomes equal to or lower than dew-point temperature of the sucked air, condensation occurs in moisture of sucked air in the evaporator, a dehumidification amount to be removed becomes large due to long time operation, reduction in absolute humidity of blown-out air is continued for a long time, absolute humidity of conditioned air is also lowered, absolute humidity in the air conditioning duct through which the conditioned air flows, and in the room and the space also become low, and a duct type air conditioning ventilation system in which condensation is less prone to occur in the air conditioning duct when the cooling operation is carried out is obtained.

By driving the compressor or the like of the air conditioning portion, air volume of the air-blowing portion in which running cost per unit air volume is largely lower than air volume of the air conditioning portion in which running cost per unit air volume is increased, conditioned air is created, and the air conditioning duct is installed in the system and therefore, energy is saved.

According to another means, the air conditioning portion has a reheating dehumidification function.

When reheating dehumidification operation is carried out, one of the heat exchangers functions as an evaporator through which low temperature and low pressure refrigerant flows, the other heat exchanger functions as a reheater through which intermediate temperature and intermediate pressure refrigerant flows. Therefore, the air becomes blown-out air having low absolute humidity at temperature which is equal to or higher than sucked air, the air is blown out from the outlet. According to this, a reheating dehumidification thermo ON state of the air conditioning portion is continued for a long time and the compressor is continuously operated. Therefore, it is possible to obtain such a duct type air conditioning ventilation system that surface temperature of the evaporator, i.e., evaporation temperature becomes equal to or lower than dew-point temperature of the sucked air, condensation occurs in moisture of sucked air in the evaporator, a dehumidification amount to be removed is increased by long time operation, absolute humidity of the blown-out air is continuously lowered for a long time, absolute humidity of conditioned air is also lowered, absolute humidity in the air conditioning duct through which conditioned air flows and in a room and a space is also lowered, and when temperature is intermediate and humidity is high such as in rainy season, condensation is less prone to be generated in the air conditioning duct.

According to another means, the circulation passage or the air conditioning unit is provided with an HEPA filter type air purification system or an electric dust collecting type air purification system.

A circulation passage or an air conditioning unit is provided with the HEPA filter type or electric dust collecting type air conditioner, and particles of mold spore level included in conditioned air are also removed. Therefore, mold is less prone to propagate in the air conditioning duct through which conditioned air passes, dust, mold, bacteria, unusual smell and the like in the air conditioning duct are less prone to enter a building, and it is possible to obtain a duct type air conditioning ventilation system capable of realizing a heathy and comfortable space.

According to another means, an inner surface of the air conditioning duct where the conditioned air flows is provided with any one of a polypropylene film, a flexible polyvinyl chloride film, and a PET film.

According to this, an inner surface of the air conditioning duct where conditioned air flows is not provided with non-woven fabric having air permeability and moisture permeability but not having large concave-convex surface, but is provided with at least any one of polypropylene film, flexible polyvinyl chloride film and PET film having non-air permeability, non-moisture permeability and small surface roughness (concave-convex surface). Therefore, dust, moisture, mold spore and the like do not enter glass wool, mold or the like is less prone to propagate there, dust is less prone to be deposited on the surface, moisture is not included, mold or the like is less prone to propagate, dust, mold, bacteria, unusual smell and the like in the air conditioning duct are less prone to enter the building, and it is possible to obtain a duct type air conditioning ventilation system capable of realizing healthy and comfortable space.

According to another means, the duct type air conditioning ventilation system further includes a temperature sensor for detecting temperature of the room or the heat resistant space, and a temperature setting portion for setting the temperature, wherein the duct type air conditioning ventilation system further includes a temperature sensor for detecting temperature of the mixing portion, and the duct type air conditioning ventilation system further includes a control portion for controlling the air conditioning portion and the air-blowing portion from detected values of the two temperature sensors and set temperature of the temperature setting portion.

According to this, average temperature in the room and the space automatically become equal to set temperature, and the temperature becomes equal to average temperature of air in the air conditioning duct within 5 K at the time of cooling operation and within 10 K at the time of heating operation as compared with average temperature of air around the air conditioning duct. Therefore, it is possible to suppress condensation inside and outside of the air conditioning duct while keeping the user's set temperature in the room and the space, and even if there is disturbance or air conditioning load is varied, it is possible to obtain a duct type air conditioning ventilation system in which mols or the like is reliably less prone to propagate.

According to another means, the duct type air conditioning ventilation system further includes a heat resistant duct located between the air conditioning duct and the outlet, wherein the heat resistant duct is provided with an aluminum fiber sound absorbing material on an inner surface of the duct where the conditioned air flows.

According to this, the sound absorbing heat resistant duct having aluminum fiber sound absorbing material which is excellent in sound absorbing properties and weather resistance is provided on an inner surface of the duct where conditioned air flows. The aluminum fiber sound absorbing material is provided between the outlet and the air conditioning duct through a mounting hole such that the ducts can be exchanged. Therefore, it is possible to lower noise from an outlet of a room where higher quietness is required such as a bedroom. There are only such few dusts that they attach to a surface of the sound absorbing material. Therefore, mold is less prone to propagate as compared with sound absorbing material such as glass wood, heat resistant properties are not deteriorated, and it is possible to obtain a duct type air conditioning ventilation system in which it is possible to easily clean the inside of the duct and the ducts can easily be exchanged from the mounting hole when it is necessary to periodically clean the duct or exchange the ducts by any chance.

Effect of the Invention

According to the present invention, it is possible to provide a duct type air conditioning ventilation system in which air conditioning is carried out in a high airtight and high heat resistant building such that temperature and humidity become uniform, fresh and clean outdoor air is introduced, dirty indoor air including moisture is discharged, air is cleaned in the building, thereby realizing a healthy and comfortable space having uniform temperature and humidity, and excellent air quality with saved energy, condensation is less prone to be generated inside and outside of the air conditioning duct, dust and the like are less prone to be deposited in the air conditioning duct, mold is also less prone to propagate, smell caused by miscellaneous bacteria is less prone to be generated, dust, mold bacteria and unusual smell in the air conditioning duct are less prone to enter the building, and a healthy and comfortable space can be realized.

It is possible to provide a duct type air conditioning ventilation system in which maintenance such as exchanging or cleaning of the air conditioning duct is unnecessary even if the duct is used for a long time, and healthy and comfortable air conditioning and ventilation can be carried out.

It is possible to provide a duct type air conditioning ventilation system in which temperature in the room and the space is set in accordance with user's taste, temperature is automatically set to a set value, and condensation inside and outside of the air conditioning duct can also be prevented.

Further, it is possible to provide a duct type air conditioning ventilation system in which noise from an air conditioning outlet is reduced by the sound absorbing heat resistant duct, mold is less prone to propagate, and when it is necessary to exchange the duct by any chance, it is possible to exchange the duct from the outlet mounting hole.

BRIEF DESCRIPTION OF THE DRAWINGS

FIG. 1 is a diagram showing a configuration of a duct type air conditioning ventilation system according to a first embodiment of the present invention;

FIG. 2 is a vertical sectional view of an air conditioning unit of the system;

FIG. 3 is a vertical sectional view of an air conditioning portion of the system;

FIG. 4 is a sectional view of an air conditioning duct and the like of the system;

FIG. 5 is a control block diagram of the system;

FIG. 6 is a construction diagram of a sound absorbing heat resistant duct in a duct type air conditioning ventilation system in a second embodiment of the present invention; and FIG. 7 is a sectional view of the sound absorbing heat resistant duct of the system.

MODE FOR CARRYING OUT THE INVENTION

First Embodiment

FIG. 1 is a diagram showing a configuration of a duct type air conditioning ventilation system 1 according to a first embodiment of the present invention.

As shown in FIG. 1, the duct type air conditioning ventilation system 1 is placed in a building 2 which is a high airtight and high heat resistant house, ducts are spread in the building 2, and rooms and spaces in the building 2 are air conditioned and ventilated entirely.

In this embodiment, an intended meaning of a room is a workroom, an intended meaning of a space is a non-workroom, the workroom is a chamber which is continuously used as habitation, work, assembly, amusement or the like or purposes belonging to them, and the non-workroom is a chamber which does not belong to the above-described chambers, and a chamber which cannot be determined as the workroom may be determined in accordance with actual usage.

An outer skin of the building 2 is covered with heat resistant material (not shown) and airtight sheet (not shown) without space, a roof 3 is a roof heat resistant specification, a basis 4 is a basic heat resistant specification, a window is a heat resistant sash 5 such as a resin sash of triple glass, a door is a heat resistant door (not shown), and a room and a space in the entire building 2 including an attic space (heat resistant space) 6 and an under floor space (heat resistant space) 7 is a heat resistant space.

A method of heat resistant can largely be divided into external heat resistant and internal heat resistant, and they method may be employed in accordance with respective merits and demerits, but a deflect in heat resistant properties is small in the outer skin of the building 2, and the building 2 which clears heat resistant properties of at least ZEH reference is targeted.

Airtightness differs depending upon specification of the airtight sheet, but airtight tape is pasted on a joint of the airtight sheet to keep continuity of an airtight layer, and a building 2 which clears at least a C-value of 1.0 is targeted.

In this duct type air conditioning ventilation system 1, an air conditioning unit 10 having a high airtight and high heat resistant properties which is covered with a wall and heat resistant material and which is subjected to airtight processing is provided on a stair landing 12 of an entrance hall 11.

An air conditioning unit 10 is provided with an airtight door (not shown) having high air airtight when it is closed. A person can come in or out into or from the stair landing 12 through the airtight door by opening and closing the airtight door.

Although the air conditioning unit 10 is provided on the stair landing 12 in the embodiment, the air conditioning unit 10 may be provided in the non-workroom such as the attic space 6, the under floor space 7, under the stairs (not shown) and a machine chamber (not shown).

Provided in the air conditioning unit 10 which produces conditioned air are a plurality of air-blowing portions 13, and an air conditioning portion 16 which is connected, through a refrigerant pipe and an electric wire 15, to an air conditioning outdoor machine 14 placed outside of the door.

The air conditioning portion 16 includes a heat exchanger (not shown) and an air blower (not shown), and an air-blowing portion 13 includes a fan (not shown) and a motor (not shown).

Outlets 22, 23 and 24 are mounted on floors or ceilings of a room A 20, a room B 21 and the entrance hall 11 in the building 2. The attic space 6 and the under floor space 7 are respectively provided with outlets 25 and 26. The outlets are air supply grills from which conditioned air blows out, and can change directions of wind.

In the embodiment, the room A 20 and the room B 21 are provided with the outlets as workrooms, but the outlets may be provided in an LDK, a bedroom, a child's room, a working room, a lavatory, a toilet, a bathroom, a kitchen and the like. Although the outlets are provided in the entrance hall 11, the attic space 6 and the under floor space 7 as the workrooms, the outlets may be provided in the stair landing 12, the under the stairs, the machine chamber, a corridor, a storeroom, a closet, a shoe rack and the like.

The plurality of air-blowing portions 13 and the outlets 22, 23, 24, 25 and 26 are connected to each other through the air conditioning ducts 30, 31, 32, 33 and 34 on one-to-one.

FIG. 1 is not simplified, but there are also other room and space having the outlets, and in accordance with this, the air-blowing portions 13 are provided, they are connected through the air conditioning duct, and the entire building 2 is air conditioned and ventilated.

The air conditioning ducts 30, 31, 32, 33 and 34 are flexible ducts having high heat resistance and high wet resistance and inner diameters of 150 mm. One ends of the air conditioning ducts 30, 31, 32, 33 and 34 are connected to adaptors (not shown) of the air-blowing portions 13, and the group passes through a vertical shaft 35 which is a heat resistant space. The heat resistant space traverses longitudinally in the building 2 on the back side of the air conditioning unit 10. As shown in FIG. 1, the vertical shaft 35 is far from the outer skin of the building 2 and a periphery of the vertical shaft 35 is surrounded by the rooms and spaces. Therefore, the vertical shaft 35 is not influenced by outdoor air and insolation, and temperature of the vertical shaft 35 easily becomes equal to those in the room and the space.

The air conditioning ducts 30, 32, 34 extend downward, and the other ends of the air conditioning ducts 30, 32, 34 are connected to the outlets 22, 24 and 26 through the under floor space 7 which is the lowermost heat resistant space of the building 2. The air conditioning ducts 31 and 33 extend upward, and the other ends of the air conditioning ducts 31 and 33 are connected to the outlets 23 and 25 through an attic space 6 which is the uppermost heat resistant space of the building 2.

Generally, concerning the inner diameter of the duct, wind speed in the duct is 5 to 7 m/s or less, and the inner diameter is selected such that there are enough air volume and static pressure of a using point due to P-Q (static pressure-air volume) characteristics of the air blower and a ventilation fan. In this embodiment, when maximum 300 $m^3/h$ passes through a duct having an inner diameter of 150 mm, wind speed becomes about 4.7 m/s and this is equal to or greater than 5 to 7 m/s. If the inner diameter is not 100 mm or greater, an instrument such as a brush for cleaning the inside does not enter the duct, it becomes difficult to perform the maintenance, and the inner diameter is increased to 150 mm as far as a duct space permits so that even if dusts are deposited, an amount of deposition of dust or the like per unit area inside of the duct.

According to this, conditioned air produced by the air conditioning unit 10 blows out into the room A 20, the room B 21, the entrance hall 11, the attic space 6 and the under floor space 7 through a conditioned air blowing passage (thick arrows) from the outlets 22, 23, 24, 25 and 26 through the air conditioning ducts 30, 31, 32, 33 and 34 all of which pass through the heat resistant space by the air-blowing portion 13.

Although each of the air conditioning ducts is connected to the outlet through the vertical shaft 35, the under floor space 7 and the attic space 6 in this embodiment, the air conditioning ducts may be connected to the outlet through an interstory space (not shown), a room, or a space surrounded by wood (not shown).

However, the space is an insulation space separated from the outer skin of the building 2. The insulation space needs to be surrounded by a room or space.

Exhaust ports 40 and 41 such as undercuts of doors (not shown) of the room A 20 and the room B 21 open between the exhaust ports and the entrance hall 11.

Exhaust ports 42 and 43 such as ventilation louvers are provided between the attic space 6, the under floor space 7 and the entrance hall 11.

A return air port 44 (suction portion) such as a suction louver is provided in an upper portion of an airtight door (not shown) of the air conditioning unit 10 on the side of the stair landing 12. All of air sucked into the air conditioning unit 10 is sucked from the return air port 44 (suction portion).

According to this, there is formed a ventilation passages (thin arrow) through which air in the room A 20, the room B 21, the attic space 6 and the under floor space 7 enters the entrance hall 11 through the exhaust ports 40, 41, 42 and 43, and the air returns from the ventilation passage 44 to the air conditioning unit 10.

By connecting the conditioned air sending passage and the ventilation passage to each other, a circulation passage (not shown) is formed.

When outdoor air is introduced into a room and indoor air is discharged to outdoor, a heat exchanging ventilation unit 50 for collecting the entire heat of the indoor air into the outdoor air is provided in the attic space 6, thereby ventilating the entire building 2.

According to the heat exchanging ventilation unit 50 in this embodiment, ventilation air volume of 24 hours is 125 $m^3/h$, strong notch ventilation air volume is 250 $m^3/h$, and total heat exchanging rate is about 70%.

A ceiling of a toilet 51 in the building 2 is provided with a ventilation exhaust port 52 such as a ventilation louver through which air in the toilet 51 is exhausted. The ventilation exhaust port 52 is connected to the heat exchanging ventilation unit 50 through the exhaust duct A 53.

A through hole of an outer wall of the building 2 is provided with an outdoor exhaust hood A 54, and the outdoor exhaust hood A 54 is connected to the heat exchanging ventilation unit 50 through an exhaust duct B 55.

The heat exchanging ventilation unit 50 includes an introduction fan (not shown) for introducing outdoor air, an exhaust fan (not shown) for evacuating indoor air, a motor (not shown), a heat exchanging element 63 for collecting entire heat of the indoor air into the outdoor air, and an element prefilter 64 which is placed on the inlet side of the indoor air of the heat exchanging element 63 for preventing dust or the like of the indoor air from adhering to the element.

The element prefilter 64 is made of non-woven fabric made of polyester or modacrylic and having a thickness of 10 mm to 20 mm, the element prefilter 64 is used at wind speed of 2.5 m/s, efficiency (weight method) is 75% and the element prefilter 64 can be regenerated by cleaning.

It is possible to make it easy to periodically perform maintenance such as cleaning for the heat exchanging element 63 and the element prefilter 64 by providing a maintainable space around the heat exchanging ventilation unit 50 or by providing an inspection port in a ceiling of a lower portion of the heat exchanging ventilation unit 50.

According to this, indoor air passes through the exhaust duct A 53 from the ventilation exhaust port 52, entire heat of the indoor air is collected by the heat exchanging ventilation unit 50, and the indoor air passes through the exhaust duct B 55 and is discharged to outdoor from the outdoor exhaust hood A 54.

An indoor air exhausting passage is formed between the ventilation exhaust port 52 and the outdoor exhaust hood A 54, and the indoor air exhausting passage is formed by the exhaust duct A 53, the heat exchanging ventilation unit 50 and the exhaust duct B 55. The indoor air exhausting passage is provided with the element prefilter 64 of the heat exchanging ventilation unit 50. But another filter may be provided in addition to or together with the element prefilter 64. The indoor air exhausting passage is provided with the exhaust fan of the heat exchanging ventilation unit 50. But another exhaust fan may be provided in addition to or together with the exhaust fan.

A through hole of an outer wall of the building 2 is provided with an outdoor air supply hood 56, and the outdoor air supply hood 56 is connected to the heat exchanging ventilation unit 50 through the air supply duct 57A.

A filter box 59 having an outdoor air cleaning filter 58 is provided in the attic space 6 and on the way to the air supply duct A 57 by providing an inspection port in a ceiling of a lower portion. The filter box 59 is provided such that maintenance such as cleaning of the filter can easily be carried out.

The outdoor air cleaning filter 58 is a fine particle filter made of polyethylene terephthalate, polypropylene or PP resin and having thickness of 35 mm. The outdoor air cleaning filter 58 can collect particles of 0.5 μm or greater, e.g., can collect mold spore, and can collect particles of 2 μm or greater with about 95% collection efficiency, and the outdoor air cleaning filter 58 is exchanged once about biennially.

A ventilation air supply port 60 blows out outdoor air into the building 2. The ventilation air supply port 60 is provided in the ceiling of the entrance hall 11 and in front of the return air port 44 of the air conditioning unit 10. The ventilation air supply port 60 is connected to the heat exchanging ventilation unit 50 through an air supply duct B 61.

According to this, outdoor air is introduced from the outdoor air supply hood 56, passes through the air supply duct A 57 and is cleaned by the filter box 59, the heat exchanging ventilation unit 50 collects entire heat, the outdoor air passes through the air supply duct B 61, and the outdoor air is introduced into a room from the ventilation air supply port 60.

The outdoor air introduction passage is formed between the outdoor air supply hood 56 and the ventilation air supply port 60, and is formed by the air supply duct A 57, the filter box 59, the heat exchanging ventilation unit 50 and the air supply duct B 61. Although the outdoor air introduction passage is provided with the outdoor air cleaning filter 58 of the filter box 59, the outdoor air introduction passage may be provided with another filter in addition to or together with the outdoor air cleaning filter 58. Although the outdoor air introduction passage is provided with the introduction fan of the heat exchanging ventilation unit 50, the outdoor air introduction passage may be provided with another introduction fan in addition to or together with the introduction fan.

The exhaust duct A 53 is an exhausting duct provided in an attic space 6 between the exhaust port 52 and the heat exchanging ventilation unit 50. Therefore, a possibility of condensation is small. The exhaust duct A 53 does not have heat resistant material or non-woven fabric on the inside of the duct so that dust and moisture are not deposited on the inside of the duct. The exhaust duct A 53 is a non-heat resistant duct which is composed of only duct made of polypropylene and which has an inner diameter of 150 mm.

The exhaust duct B 55 and the air supply duct A 57 are duct which are provided in the attic space 6 between the outdoor exhaust hood A 54 or the outdoor air supply hood 56 and the heat exchanging ventilation unit 50 and which are in contact with outdoor air. Therefore, the exhaust duct B 55 and the air supply duct A 57 are flexible air conditioning ducts having high heat resistance and high wet resistance having an inner diameter of 150 mm.

The air supply duct B 61 is provided in the attic space 6 between the ventilation air supply port 60 and the heat exchanging ventilation unit 50. Therefore, heat resistance and wet resistance of the inner diameter of 150 mm are high, and the air supply duct B 61 has the same specification as that of the flexible air conditioning duct.

Since the heat exchanging ventilation unit 50, the exhaust duct B 55 and the air supply duct A 57 are in contact with the outdoor air, there is a possibility that dust and the like from outdoor and condensation enter, it is necessary to provide an inspection port in the vicinity such that they can be cleaned or exchanged periodically The toilet 51 is provided with an outlet from which conditioned air blows out. A louver 65 through which air comes in and out is provided between the toilet 51 and the entrance hall 11. By operating the heat exchanging ventilation unit 50, a portion of air which returns to the entrance hall 11 and which conditions air in the room and the heat resistant space flows into the toilet 51 from the louver 65, and when a situation is stable, air quality in the toilet 51 becomes close to conditioned air (temperature and humidity and cleaned degree).

By operation of the heat exchanging ventilation unit 50, fresh outdoor air which is cleaned by the outdoor air cleaning filter 58 provided in the outdoor air introduction passage is introduced by the introduction fan of the heat exchanging ventilation unit 50. Air which is made dirty by moisture of the so-called dirty zone such as the toilet 51 and a portion of air which is air-conditioned in the heat resistant space pass through the indoor air exhausting passage from the ventilation exhaust port 52 through the indoor air exhausting passage, and entire heat is exchanged with outdoor air by the heat exchanging element 63 and the air is discharged to the outdoor. Therefore, dust or mold spore do not enter the building 2 from outdoor, moisture and smell of the toilet or the like are discharged to the outdoor, ventilation in the building 2 is carried out with small energy by the heat exchange, and dust, moisture, mold spore and the like in the building can be reduced.

Although the toilet 51 is provided with the ventilation exhaust port 52 in this embodiment, the ventilation exhaust port and louver may be provided in a so-called dirty zone which is a room and a space where smell, moisture and harmful material are generated in a lavatory, a bathroom or a kitchen other than the toilet. In such a case, they can directly be discharged outside of a room without through another room or space. However, when the heat exchanging element 63 of the heat exchanging ventilation unit 50 is less prone to be deteriorated by moisture of a bathroom or oil content in a kitchen, it is necessary to provide a later-described another ventilation fan.

The ventilation exhaust port 52 may be provided in a room or a space located downstream of a circulation passage (ventilation passage) such as the entrance hall 11 and the air conditioning unit 10. In such a case, a portion of indoor air of a room or a space is discharged to outside of the room together with dust or moisture generated by normal life in that room or space, but it is necessary to provide also the dirty zone with the ventilation exhaust port 52 or to provide a later-described another ventilation fan such that the moisture or the like of the dirty zone does not flow into the room or the space.

A ceiling of a bathroom 66 in the building 2 is provided with a ceiling embedded type ventilation fan 67 of strong notch air volume of 80 $m^3$/h. The ceiling embedded type ventilation fan 67 discharges air in the bathroom 66. The ceiling embedded type ventilation fan 67 is connected, through an exhaust duct C 68, to an outdoor exhaust hood C 69 provided in a through hole in an outer wall of the building 2.

The exhaust duct C 68 is provided in the heat resistant space between the outdoor exhaust hood C 69 and the ceiling embedded type ventilation fan 67, the exhaust duct C 68 has an inner diameter 100 mm and high heat resistance and wet resistance because the exhaust duct C 68 comes into contact with the outdoor air, and the exhaust duct C 68 has the same specification a flexible air conditioning duct.

Since the ceiling embedded type ventilation fan 67 and the exhaust duct C 68 come into contact with the outdoor air, there is a possibility that condensation occurs and dust enters from outdoor, and it is necessary that an inspection port is provided in the vicinity so that cleaning and exchanging of the duct can be carried out periodically.

The bathroom 66 is not provided with an outlet from which conditioned air blows out, a louver 70 through which air comes in and out is provided between the bathroom 66 and the entrance hall 11. By operating the ceiling embedded type ventilation fan 67, a portion of air which returns to the entrance hall 11 and which conditions air in the room and the heat resistant space flows into the bathroom 66 from the louver 70, and when the ceiling embedded type ventilation fan 67 is stable, air in the bathroom 66 has quality (temperature and humidity, cleaning degree or the like) which is close to conditioned air.

Although the bathroom 66 is provided with the ceiling embedded type ventilation fan 67 in this embodiment, the ventilation fan may be provided in a room or a space where strong smell, a large amount of moisture, harmful material and the like are temporarily generated or accumulated due to bathing, face-washing, laundry, bowel movement, cooking and the like in a lavatory, a toilet or a kitchen other than the bathroom. According to this, the strong smell can swiftly and directly be discharged outside the room.

Although the ceiling embedded type ventilation fan 67 is provided in this embodiment, if the ventilation fan can swiftly and directly discharge the smell outside the room, the ventilation fan may be a wall-mounting type fan or an intermediate duct type fan, or the ventilation fan may be a heat exchanging ventilation unit in which heat exchanging element is less prone to be deteriorated by moisture of a bathroom or the like or by oil in a kitchen or the like.

The air conditioning unit 10 is provided with a plurality of filters (filter portions) for cleaning air in the building 2.

In one of the plurality of filters, a return air port filter 75 (filter portion) is provided in the return air port 44 (suction portion) such as a suction louver of the air conditioning unit 10 such that the return air port filter 75 can be detached from the stair landing 12 and maintenance such as cleaning can be carried out.

Further, the air conditioning portion 16 is provided with an air conditioning portion filter 76 (filter portion) for cleaning sucked air and heat exchanger from adhering.

The air-blowing portion filter 77 (filter portion) is provided upstream of a fan (not shown) of the air-blowing portion 13 so that dust and the like do not blow out into the air conditioning ducts 30, 31, 32, 33 and 34, the rooms A 20 and B 21, the entrance hall 11, the attic space 6 and the under floor space 7.

The air conditioning portion filter 76 and the air-blowing portion filter 77 can be detached from the body and maintenance such as cleaning can be carried out periodically.

The return air port filter 75 is non-woven fabric having a thickness of 15 mm to 30 mm made of polyester or modacrylic, the return air port filter 75 is used at wind speed of 1 m/s, efficiency (weight method) is 80% or more, and the return air port filter 75 can be reproducible by cleaning.

The air conditioning portion filter 76 is formed by weaving polypropylene fiber into honeycomb (comb) to form resin frame, efficiency is poor, but pressure loss is small, there are no water absorbability and moisture absorbability, and cleaning by washing is easy.

The air-blowing portion filter 77 is non-woven fabric made of material other than polyester and having a thickness of 2 mm, the air-blowing portion filter 77 is used at standard wind speed of 2 m/s, efficiency (weight method) is 30%, pressure loss is low, and the air-blowing portion filter 77 is reproducible by washing. If it is desired to reduce maintenance frequency such as cleaning, although efficiency is lowered a little, polypropylene fiber may be formed by weaving polypropylene honeycomb into resin frame like the air conditioning portion filter 76.

An electric dust collecting type air purification system 80 is provided between the air conditioning portion 16 and the air-blowing portion 13 downstream of the return air port 44 in the air conditioning unit 10. The air purification system 80 includes a prefilter and an electric dust collector.

The prefilter is a filet filter made of SUS having about 20 to 50 meshes located upstream of the electric dust collector. Mainly visibly coarse-grained particles having particles diameters of 10 to 20 μm or greater are removed from air sucked from the return air port 44 and from air blown out from the air conditioning portion 16, and the particles pass through the electric dust collector.

The prefilter may be made of resin such as polypropylene depending upon usage.

The electric dust collector located downstream of the prefilter removes further fine particles, particles having particle diameters of 0.3 μm or greater, e.g., floating particles such as mold spore in the air, dust, pollen dust, yellow sand, PM 2.5 and the like.

Although the dust collecting type air purification system 80 is provided in this embodiment, the air purification system 80 may be of an HEPA filter type such as fine mesh HEPA filter (High Efficiency Particulate Air Filter), materials to be removed may be selected depending upon kinds and degree of dust, bacteria and harmful material to be removed, a shape of a machine, a shape of the air conditioning unit 10, wind speed of air in the air conditioning unit 10, and frequency of maintenance such as cleaning. For example, when virus having a particle diameter of 0.1 μm or greater which can be captured by the HEPA filter is objective, the filter should be of HEPA filter type.

In the case of the prefilter and the electric dust collector, airtight doors of the air conditioning unit 10 are opened, and maintenance such as cleaning and exchanging can easily be carried out.

Although the air purification system 80 is provided in the air conditioning unit 10 in this embodiment, the air purification system 80 may be provided in the middle of a ventilation passage which returns to the air conditioning unit 10 from the room A 20 or the like.

The air-blowing portion 13 in the air conditioning unit 10 is separated from the air blower (not shown) of the air conditioning portion 16 in this embodiment, configurations of any air-blowing portion 13 or air blower may be employed, only if air conditioning and blowing function for heat-exchanging in the heat exchanger (not shown) and transmitting function for blowing wind to the rooms and spaces can effectively be functioned.

In this embodiment, the air conditioning unit 10 is an air conditioning room which is airtightly covered and closed by a wall and a heat resistant material. But the air conditioning unit 10 may be a compact body which is covered with a plate or a heat resistant material. If air sucked from the return air port 44 and blown-out air of the air conditioning portion 16 are well mixed without shortcut, the air conditioning portion 16, the air-blowing portion 13 and the like may be provided by surrounding a portion of a space such as the stair landing 12, under stairs, and corridor, and a portion of the space may be opened. However, it is preferable that the air conditioning portion 16 and the air-blowing portion 13 have such sizes that maintenance can be performed easily.

A sensor for detecting temperature, humidity, and concentration of dust of air after it passes through the air purification system 80, and an air conditioning unit controller 110 having a control portion are provided below the air purification system 80 in the air conditioning unit 10. The entrance hall 11 where return air from the room and the space and outdoor air are collected is provided with a sensor which detects temperature, humidity and concentration of dust of air in the entrance hall 11 where the air is mixed and uniformed, a temperature setting portion for setting temperature of the entrance hall 11 and a room temperature controller 120 having the control portion.

The air conditioning unit controller 110 and the room temperature controller 120 are connected to each other through a signal line which exchanges signals between the control portion of the air conditioning portion 16 and the control portion of the air-blowing portion 13.

FIG. 2 is a vertical sectional view of the air conditioning unit 10.

The air conditioning unit 10 is covered with and tightly closed by a wall (including tightly closed door) and the heat resistant material. The air conditioning unit 10 is provided with a return air port 44 (suction portion) which is provided on the stair landing 12 of the entrance hall 11. Air in the room A 20 or the like returns to the air conditioning unit 10 of the return air port 44 is provided on the upper portion of the tightly closed door (not shown) which comes into contact with the stair landing 12 of the entrance hall 11. The air conditioning unit 10 includes the return air port filter 75 (filter portion).

The air conditioning portion 16 is provided on a front surface of the return air port 44 and separated therefrom at a deep location. In the plurality of air-blowing portions 13, bodies and the like are embedded below the inside of the air conditioning unit 10 in the vertical shaft 35 on a back side of the air conditioning unit 10.

The air conditioning portion 16 sucks a portion of air (air which returns from the room and the space and air in which introduced outdoor air is mixed in the entrance hall 11) sched from the return air port 44 by the air-blowing portion 13 from suction portions 86 in an upper surface and a front surface by the air blower (not shown). The air conditioning portion 16 cleans the air by means of the air conditioning portion filter 76 (filter portion), and blows out air which is heat-exchanged with refrigerant by a heat exchanger (not shown) to a position located lower than an outlet 87.

The air purification system 80 is provided between the air conditioning portion 16, the return air port 44 and the air-blowing portion 13 such that the air purification system 80 vertically partitions the air conditioning unit 10.

A mixing portion 85 is located below the air purification system 80 and in front of the air-blowing portion 13. The mixing portion 85 is a space where a portion of air (return air from the room and the space and air mixed with introduced outdoor air in the entrance hall 11) sucked from the return air port 44 and blown-out air which is blown out from the air conditioning portion 16 are mixed.

The air-blowing portion 13 passes, through the air purification system 80, blown-out air which is blown out from the air conditioning portion 16 through a fan (not shown) and a portion of air which is not sucked by the air conditioning portion 16 from the return air port 44 and bypasses and flows in, the air-blowing portion 13 cleans the air, the air-blowing portion 13 sucks conditioned air which is mixed by the mixing portion 85 from a suction port 88, the air-blowing portion 13 further cleans the air by the air-blowing portion filter (filter portion) 77, and the air-blowing portion 13 flows the air into the air conditioning ducts 30, 31, 32, 33 and 34.

FIG. 3 is a vertical sectional view of the air conditioning portion 16.

Air sucked from the suction portions 86 in the upper surface and the front surface of the air conditioning portion 16 is cleaned by the air conditioning portion filter 76, the air is heat-exchanged with the refrigerant in heat exchangers 91 and 92, and the air is blown out from the outlet 87 by an air blower 90 in a direction in which a louver 94 is directed.

The air conditioning portion 16 includes three operation modes, i.e., a cooling mode, a heating mode and a reheating and dehumidification mode. The heat exchangers 91 and 92 change characteristics of flowing refrigerant depending upon the operation modes, and roles thereof are changed. That is, at the time of the cooling operation, both the heat exchangers 91 and 92 function as evaporators through which low temperature and low pressure refrigerant flows, and at the time of the heating operation, both the heat exchangers 91 and 92 function as condensers through which high temperature and high pressure refrigerant flows.

At the time of the reheating dehumidification operation, the heat exchanger 91 functions as an evaporator through which low temperature and low pressure refrigerant flows, and the heat exchanger 92 functions as a reheater through which intermediate temperature and intermediate pressure refrigerant flows. Temperature of a surface of the heat exchanger 91 (evaporator) becomes equal to evaporation temperature refrigerant having temperature which is equal to or lower than dew-point temperature of sucked air. Therefore, temperature of air which passes is lowered, and absolute humidity is lowered, condensed water (dehumidified water) which occurs condensation on the surface of the heat exchanger 91 (evaporator) flows toward a drain pan 93 located below the heat exchanger 91 (evaporator), and the condensed water flows to an outdoor location or the like by a drain hose (not shown). Since temperature of a surface of the heat exchanger 92 (reheater) becomes equal to condensation temperature of refrigerant having temperature which is equal to or higher than sucked air, temperature of air which passes rises. The two sets of air which pass through the two heat exchangers 91 and 92 join up by the air blower 90 and mixed with each other, and becomes blown-out air having low absolute humidity at the temperature equal to or higher than the sucked air and the air is blown out from the outlet 87.

FIG. 4 is a sectional view of the air conditioning ducts 30, 31, 32, 33 and 34, the air conditioning duct B 61, the exhaust duct B 55 and the air supply duct A 57.

The air conditioning ducts 30, 31, 32, 33 and 34, the exhaust duct B 55 and the air supply duct A 57 have high heat resistance, high wet resistance and flexibility. Inner diameters thereof are 150 mm.

Each of these ducts has such a configuration that it is made of, from its outer side; a flexible outer coated material 100 made of polyethylene sheet having about 0.08 mm thickness; a heat resistant material 101 such as glass wool having 25 mm thickness and about 24 kg/m$^3$ concentration; an internal covering material 102 such as polypropylene film, soft vinyl chloride film and PET film, having non-air permeability and non-moisture permeability with respect to polyester non-woven fabric, small surface roughness (concavo-convex surface), and about 0.1 mm thickness; and a wind passage 103 through which conditioned air passes. A molding core material (not shown) such as polypropylene resin is provided between the internal covering material 102 and the inside of the heat resistant material 101 so that even if the air conditioning ducts 30 to 34 are bent, they do not buckle, and a sectional area of the inside wind passage 103 can be secured.

The glass wool having 25 mm thickness and about 24 kg/m$^3$ concentration is used as the heat resistant material 101 in this embodiment. However, when an outer diameter of the duct becomes large and it is difficult to secure, in the heat resistant space of the building 2, a space through which the duct passes, it is possible to employ glass wool having such a configuration that concentration of the heat resistant material is 100 kg/m$^3$ or greater and thickness is 10 mm or less, thereby securing a space for the duct. In this case, since the heat resistance of the duct is slightly deteriorated, it is preferable that air conditioning ability is enhanced by enhancing the heat resistance of the heat resistant space through which the duct passes, by passing the duct through a heat resistant space which is far from the outer skin of the building 2, or by increasing the number of the outlets 25, 26 of the heat resistant space.

FIG. 5 is a control block diagram of the system.

The air conditioning unit controller 110 includes a temperature sensor 111 which detects temperature of conditioned air in the mixing portion 85 in the air conditioning unit 10 after the air passes through the air purification system 80 and before the air is sucked into the air-blowing portion 13, a humidity sensor 112 which detects humidity of the air, and a duct sensor 113 which detects mass concentration of dust in the air. The air conditioning unit controller 110 sends data to a control portion 114.

A room temperature controller 120 includes a temperature sensor 121 which detects temperature of air sucked by the return air port 44 (air obtained by mixing return air from a room and a space and introduced outdoor air in entrance hall 11), a humidity sensor 122 which detects humidity of the air, a duct sensor 123 which detects mass concentration of dust in the air, and a temperature setting portion 125 which sets temperature of the air. The room temperature controller 120 sends data to a control portion 124.

The air conditioning portion 16 includes a suction temperature sensor 133 which detects temperature of sucked air which is heat-exchanged in the heat exchangers 91 and 92. The air conditioning portion 16 also includes an air blower control portion 131 which sends data to a control portion 130 and which controls the number of rotations of the air blower 90 by instructions from the control portion 130, and a louver control portion 132 which controls an angle of the louver 94.

The air conditioning outdoor machine 14 includes a compressor control portion 136 which controls the number of rotations of a compressor (not shown) by instructions from a control portion 135, and an outdoor air blower control portion 137 which controls the number of rotations of an outdoor air blower (not shown).

The air-blowing portion 13 includes a motor control portion 141 which controls the number of rotations of a motor (not shown) by instructions from a control portion 140.

The control portion 114 of the air conditioning unit controller 110 and the control portion 124 of the room temperature controller 120 are connected to each other through a signal line 150, and exchange signals therebetween.

The control portion 114 of the air conditioning unit controller 110 and the control portion 130 of the air conditioning portion 16 are connected to each other through a signal line 151, and exchange signals therebetween.

The control portion 130 of the air conditioning portion 16 and the control portion 135 of the air conditioning outdoor machine 14 are connected to each other through a signal line 152, and exchange signals therebetween.

The control portion 114 of the air conditioning unit controller 110 and the control portion 140 of the plurality of air blowers 13 are connected to each other through a signal line 153, and exchange signals therebetween.

The air purification system 80 includes an electric dust collector control portion 161 which controls operation of the electric dust collector by instructions of a control portion 160.

The control portion 114 of the air conditioning unit controller 110 and the control portion 160 of the air purification system 80 are connected to each other through a signal line 154, and exchange signals therebetween.

The heat exchanging ventilation unit 50 includes a motor control portion 166 which controls the number of rotations of the motor by instructions of a control portion 165.

The control portion 114 of the air conditioning unit controller 110 and the control portion 165 of the heat exchanging ventilation unit 50 are connected to each other through a signal line 155, and exchange signals therebetween.

In the above-described configuration, the air conditioning unit controller 110 and the room temperature controller 120 are connected to the air conditioning portion 16, the plurality of air blowers 13, the air purification system 80 and the heat exchanging ventilation unit 50 through the respective plurality of signal lines, perform communications therebetween, and appropriately control the duct type air conditioning ventilation system 1. In this embodiment, communication is performed through a wired system using signal lines, but the control portions may be provided with respective wireless communication units, and communication may be performed through a wireless system such as Wi-Fi (registered trademark), Bluetooth (registered trademark), infrared ray or the like.

In the above-described configuration, if the temperature setting portion 125 of the room temperature controller 120 sets temperature and the duct type air conditioning ventilation system 1 is operated, the air conditioning portion 16, the plurality of air-blowing portions 13, the air purification system 80 and the heat exchanging ventilation unit 50 are appropriately controlled and operated by the air conditioning unit controller 110.

Returning air after air conditioning in the spaces such as the rooms, the attic space 6, the under floor space 7 and the like pass through the ventilation passage by the plurality of air-blowing portions 13, and return to the entrance hall 11.

Further, outdoor air which is cleaned by the filter box 59 and heat-exchanged with indoor air in the heat exchanging ventilation unit 50 enters the entrance hall 11 from the ventilation air supply port 60.

These airs are mixed in the entrance hall 11, cleaned by the return air port filter 75 (filter portion) of the return air port 44 of the air conditioning unit 10, and the airs flow into the air conditioning unit 10.

The air conditioning portion 16 sucks, from the suction portion 86, a portion of air sucked from the return air port 44, the air conditioning portion 16 cleans the air by the air conditioning portion filter 76 (filter portion), and the air conditioning portion 16 downwardly blows out air which is heat-exchanged with refrigerant from the outlet 87.

In the plurality of air-blowing portions 13, the remaining air sucked from the return air port 44 bypasses the air conditioning portion 16 and passes through the air purification system 80 together with blown-out air which is blown out from the air conditioning portion 16, further fine dust and bacteria are removed, the air is cleaned, and the air becomes well mixed conditioned air by the mixing portion 85.

The plurality of air-blowing portions 13 suck conditioned air from the suction port 88, further clean the air by the air-blowing portion filter (filter portion) 77, and flow the air into the air conditioning ducts 30, 31, 32, 33 and 34.

In this embodiment, air volume of the air conditioning portion 16 is about 600 $m^3$/h, temperature of blown-out air is about 10 K at the time of cooling operation and about 20 K at the time of heating operation with respect to temperature of sucked air. But since total air volume of the plurality of air-blowing portions 13 is about 1500 $m^3$/h, among air sucked from the return air port 44, air which bypasses the air conditioning portion 16 of remaining about 900 $m^3$/h is mixed in the mixing portion 85, conditioned air within about 5 K at the time of cooling operation and about 10 K at the time of heating operation of about 1500 $m^3$/h is sucked into the plurality of air-blowing portions 13.

Here, the building 2 has high airtight and high heat resistance, and there is almost no temperature gradient in the ventilation passage. Therefore, temperature of sucked air of the air conditioning portion 16 is almost the same as temperature of the entrance hall 11, average temperature of air which returns from each room and each space, and average temperature of each room and each space.

The air conditioning ducts 30, 31, 32, 33 and 34 pass through the vertical shaft 35 which is the heat resistant space. The air conditioning duct 33 blows out conditioned air from the outlet 25 in the attic space 6 (heat resistant space), and air conditions and ventilates the attic space 6 which is located at the uppermost portion of the building 2 and which is prone to be influenced by radiation heat of the roof or influenced by outdoor. The air conditioning duct 34 blows out conditioned air from the outlet 26 in the under floor space 7 (heat resistant space), and air conditions and ventilates the under floor space 7 which is located at the lowermost portion of the building 2 and which is prone to be influence of underground or outdoor.

The air conditioning ducts 30 and 32 pass through the under floor space 7 (heat resistant space), blow out the conditioned air from the outlets 22 and 24, and air condition and ventilate the room A 20 and the entrance hall 11.

The air conditioning duct 31 passes through the attic space 6 (heat resistant space), blows out conditioned air from the outlet 23, and air conditions and ventilates the room B 21.

That is, conditioned air which is cleaned by the plurality of filter portions and the air purification system 80 within about 5 K at the time of the cooling operation and within about 10 K at the time of the heating operation with respect to temperature of each room and each space of about 1500 $m^3$/h produced in the air conditioning unit 10 pass through the air conditioning ducts 30, 31, 32, 33 and 34 which all pass through the heat resistant space by the air-blowing portion 13, and the air is blow out from the outlets 22, 23, 24, 25 and 26 into the rooms A 20 and B 21, the entrance hall 11, the attic space 6 and the under floor space 7. Therefore, even if the conditioned air passes through the air conditioning ducts 30, 31, 32, 33 and 34, there is almost no temperature gradient, cleaned conditioned air of large air volume within about 5 K at the time of the cooling operation and within about 10 K at the time of the heating operation with respect to temperature of each room and each space is blown out as it is from the outlets 22, 23, 24, 25 and 26, and the building 2 is air conditioned and ventilated at extremely comfortable and uniform temperature and extremely excellent air quality.

Further, a large air volume of cleaned and conditioned air within about 5 K at the time of the cooling operation and within about 10 K at the time of the heating operation passes through the air conditioning ducts 30, 31, 32, 33 and 34 with respect to temperature of the heat resistant space through which the air conditioning ducts pass as described above. Therefore, moisture, dust and bacteria are less prone to be accumulated and deposited especially in the duct without occurring condensation inside and outside of the duct.

Conditioned air which is air-conditioned and ventilated in each room and each space passes through the exhaust ports 40, 41, 42 and 43, and returns to the entrance hall 11, and returns from the return air port 44 to the air conditioning unit 10.

Air (air in which return air from the room and the space in the entrance hall 11 and introduced outdoor air are mixed) sucked from the return air port 44 is again air-conditioned by the air conditioning unit 10, and the air is supplied to the room and the space. Therefore, heat and air quality of the returning air are re-utilized, and energy is saved as a result.

A portion of air in which return air from the room and the space and introduced outdoor air are mixed in the entrance hall 11 flows into the toilet 51 from the louver 65 by the heat exchanging ventilation unit 50. Air including moisture, smell, harmful material and the like of the toilet 51 totally exchanges heat with outdoor air which is cleaned by the filter box 59 in the heat exchanging ventilation unit 50, and the air is discharged to outdoor from the outdoor exhaust hood A 54. A portion of return air from the room and the space is discharged to outdoor, and a portion of air in which return air from the room and the space and introduced outdoor air are mixed is replaced as air of the toilet 51.

Cleaned fresh outdoor air after it is totally heat-exchanged is blown out from the ventilation air supply port 60 of the entrance hall 11, the outdoor air is mixed, in the entrance hall 11, with return air from the room and the space, the air flows into the air conditioning unit 10 from the return air port 44, and is blown to the room and the space.

When a large amount of moisture or strong smell is temporarily generated in the bathroom 66 during bathing for example, the ceiling embedded type ventilation fan 67 is operated with strong notch. According to this, a portion of air in which return air from the louver 70, the room and the space and introduced outdoor air are mixed is replaced by air in the bathroom 66 while swiftly and directly discharging air to outdoor. Therefore, air quality (temperature and humidity, cleanness and the like) in the bathroom 66 becomes close to conditioned air when environment is stable.

A blowing air volume of each air-blowing portion 13 is determined based on a volume of each room and each space. A blowing air volume which is necessary for air conditioning is preferably at least 8 $m^3$/h or more and ideally, 20 $m^3$/h or more per 2.5 $m^3$ of a room, and the blowing air volume is adjusted depending upon an air conditioning load such as a size of the room and insolation. Since the air-blowing portion 13 rotates a sirocco fan (not shown) by an efficient DC motor (not shown), the air conditioning load controls the number of rotations of the sirocco fan (not shown) by means of the control portion 140 and the motor control portion 141.

The number of air-blowing portions 13 is basically one per one outlet, the air-blowing portions 13 are connected to each other through one air conditioning duct, but when there are enough air-blowing portions 13 with respect to the above-described necessary blowing air volume, the air conditioning duct is branched in an intermediate portion thereof depending upon a shape of the room or the space, and the number of outlets can be increased. However, there is a possibility that a branch portion becomes resistance, wind speed is changed and moisture, dust, bacteria and the like are accumulated or deposited, and maintenance such as cleaning becomes difficult. Therefore, the number of these elements is preferably 1:1:1 if possible, and when it is absolutely necessary to provide a branch, it is necessary to provide an inspection port in the vicinity thereof so that cleaning and exchange can be carried out in the branch later.

The ability and the number of air conditioning portions 16 are selected depending upon an air conditioning load of the building 2. When the ability is selected, if an air conditioner or the like of ability (appropriately rating ability, 100% at most with respect to air conditioning load of the building) in which operation of the compressor (not shown) is continued at low frequency (about 30 Hz) in which COP is higher, operation at low frequency is continued when the environment is stable, and this is preferable because temperature and humidity become stable with more saved energy and with no hunting.

It is preferable that blown-out air which is air-conditioned by the air conditioning portion 16 and air (air in which return air from the room and the space and outdoor air are mixed in the entrance hall 11) sucked from the return air port 44 are reliably mixed, and air volume of the air conditioning portion 16 is set to air volume which is equal to or smaller than 50% or less of total air volume of the plurality of air-blowing portions 13 so that air becomes conditioned air having a temperature difference within about 5 K at the time of the cooling operation and within about 10 K at the time of the heating operation with respect to uniform temperature having small temperature difference between the room and the space, i.e., target temperature of the room and the space.

By blowing the conditioned air from the outlets provided in ceilings or walls of the room and the space through the plurality of air conditioning ducts by the plurality of air-blowing portions 13, the room and the space are air-conditioned and ventilated at uniform and comfortable temperature.

For example, when a floor area of a building is about 100 $m^2$ and a ceiling height is 2.5 m, an air conditioning portion 16 having cooling ability of 4 kW is installed, and air conditioning air volume at the time of cooling operation in a weak wind mode is 600 $m^3$/h. The air-blowing portion 13 which blows wind into the room and the space is set such that blast volume per one air-blowing portion 13 is about 100 $m^3$/h at weak air volume, about 150 $m^3$/h at intermediate air volume, and 200 $m^3$/h at strong air volume, total air volume in the case of ten air-blowing portions 13 becomes about 1000 $m^3$/h to 2000 $m^3$/h, this is greater than air conditioning air volume of the air conditioning portion 16, and air volume of 30 to 60% of the total air volume is set as air conditioning air volume (weak wind mode) of the air conditioning portion 16.

The air conditioning air volume is air volume which passes through a heat exchanger (not shown) of the air conditioning portion 16. When the air conditioning portion 16 has a wind passage which bypasses the heat exchanger to avoid a pressure loss caused by passage of the heat exchanger so that conditioned air can be blown out to each room at large air volume, air volume of the bypass wind passage is eliminated from the air conditioning air volume.

As an outdoor air introducing amount which is introduced by the heat exchanging ventilation unit 50, and an indoor air discharging amount, so-called ventilation air volume is ventilation air volume 125 $m^3$/h for 24 hours when the floor area is about 100 $m^2$, a ceiling height is 2.5 m and ventilation times is 0.5 times/h.

During bathing in the bathroom 66, since exhaust air volume of the ceiling embedded type ventilation fan 67 is increased by about 80 $m^3$/h, the exhaust amount temporarily becomes too large, but time thereof is short and an introduction amount of outdoor air of the heat exchanging ventilation unit 50 is slightly increased by its load. Therefore, moisture, carbon dioxide, smell, VOC, dust, bacteria and the like can be discharged while introducing an appropriate amount of fresh and air-conditioned outdoor air as the entire building 2, and it is possible to realize saved energy, healthy and comfortable air conditioning and ventilation.

In summer, blowing out temperature of the air conditioning portion 16 in the cooling operation at room temperature set temperature of 25° C. is 15° C. which is lower, by about 10 K or more, than temperature 26° C. of air sucked from the return air port 44, but air of 26° C. sucked from the return air port 44 is mixed, and the temperature becomes 21° C. which is lower by about 5 K with respect to temperature of air sucked from the return air port 44, and the air is sucked into the air-blowing portion 13 and passes through the air conditioning duct. Therefore, there is no temperature gradient, and the air is blown out into each room and space from the outlets at 21° C. When a situation is stable, most of the heat resistant spaces through which the air conditioning ducts pass have the outlets, and the air passes through the air-conditioned heat resistant space. Therefore, surface temperature of the inner periphery of the air conditioning duct becomes 22° C. which is close to 21° C., and the outer peripheral surface temperature becomes 24° C. which is close to 25° C. of room temperature which is heat resistant space.

In the case of relative moisture of 60% at room temperature of 25° C. of the heat resistant space, dew-point temperature is 17° C., and condensation does not occur on the outer peripheral surface of the air conditioning duct.

Further, when outdoor temperature is lowered, air conditioning load is reduced, the air conditioning portion 16 becomes thermo-OFF and the compressor is stopped, temperature and humidity of the blown-out air of the air conditioning portion 16 is 25° C. which is the same as the room temperature, condensation water condensed in the evaporator of the air conditioning portion 16 is again evaporated and even if the relative humidity becomes 80% which is slightly high, dew-point temperature is 21° C., and condensation does not occur also on the inner peripheral surface of the air conditioning duct.

As comparison, in a conventional duct type air conditioning ventilation system, since air blown out from the air conditioning portion flows into duct as it is, blown-out air of 15° C. which is lower than temperature 26° C. of suckled air of the air conditioning portion by about 10 K or greater flows, this cools the inner peripheral surface of the duct, and temperature thereof becomes about 17° C. In this state, if thermo is turned OFF and the compressor is stopped, temperature of blown-out air becomes dew-point temperature 21° C. at temperature 25° C. relative humidity 80%, and if the air passes through the duct, condensation occurs on the inner peripheral surface of the duct.

In winter, at the room temperature is set temperature 21° C., blowing out temperature of the air conditioning portion 16 of the heating operation is 42° C. which is higher, by about 20 K or more, than temperature 20° C. of air sucked from the return air port 44, but the air is mixed with air sucked from the return air port 44 of 19° C., this temperature becomes 30° C. which is higher, by about 10 K, than temperature of air sucked from the return air port 44. Since the air passes through the air conditioning duct by the air-blowing portion 13, there is no temperature gradient, and air blows out into each room and each space from the outlets at 30° C. When a situation is stable, most of the heat resistant spaces through which the air conditioning ducts pass have outlets, the inner peripheral surface temperature of the air conditioning duct becomes 28° C. which is close to 30° C., and the outer peripheral surface temperature becomes 23° C. which is close to the room temperature of 21° C. of the heat resistant space.

Temperature and humidity of blown-out air of the air-blowing portion 13 are temperature of 30° C., relative humidity of 32%, dew-point temperature of 12° C., and condensation does not occur on the inner peripheral surface of the air conditioning duct. Even if the blown-out air is humidified by the humidifier and relative humidity rises to 50%, since the dew-point temperature is 18° C., condensation does not occur.

When outdoor temperature rises and air conditioning load is reduced and the air conditioning portion 16 is turned thermo-OFF and the comfortable is stopped, temperature and humidity of the blown-out air of the air-blowing portion 13 are such that the temperature is 21° C. which is the same as the room temperature, the relative humidity becomes as high as 60%, the dew-point temperature is 12° C., and condensation does not occur on the inner peripheral surface of the air conditioning duct. Even if the air is humidified by the humidifier and the relative humidity rises to 80%, the dew-point temperature is 17° C. and condensation does not occur.

As comparison, in the conventional duct type air conditioning ventilation system, when dust does not pass through a heat resistant space in a house and its space is not air-conditioned and heat resistance performance of the duct is also low, temperature of its space is close to outside air temperature, and air which is blown out from the air conditioning portion flows into a duct as it is in a state where the outside air temperature is 0° C. and space temperature is 2° C. for example. Therefore, blown-out air of 40° C. which is higher than temperature of 20° C. of sucked air of the air conditioning portion by about more than 20 K flows, and when the relative humidity is 20%, the dew-point temperature becomes 13° C., and when the surface temperature in the duct becomes 13° C. or lower, condensation occurs on the inner peripheral surface of the duct. In this state, if thermo is turned OFF and the compressor is stopped, the blown-out air becomes 21° C., relative humidity becomes 60% and dew-point temperature becomes 13° C., and condensation occurs similarly.

If the air is humidified and relative humidity rises by a humidifier, the amount of condensation is further increased.

Total air volume 1500 $m^3$/h of the plurality of air-blowing portions 13 is largely greater than the air volume 600 $m^3$/h of the air conditioning portion 16, conditioned air within about 5 K at the time of the cooling operation and within about 10 K at the time of the heating operation is blown out to the room and the space with respect to temperature of the room and the space of about 1500 $m^3$/h. Therefore, temperature in the room and the space is stabilized for a long time. Further, when ability of the air conditioning portion 16 is determined, an air conditioner or the like of ability in which operation of a compressor (not shown) at low frequency of higher COP (appropriate rating ability of 100% at most with respect to air conditioning load of the building) is selected. Therefore, set temperature of the air conditioning portion 16 is set slightly lower (within about 5 K at the time of cooling operation) and slightly higher (within about 10 K at the time of heating operation) than average temperature of the room and the space so that the compressor (not shown) is operated for a long time at low frequency when the situation is stable for saving energy. In the house, airtight is high and heat resistance is also high. Hence, average temperature in the room and the space, temperature of air sucked from the return air port 44 (suction portion) and temperature of air sucked from the air conditioning portion 16 are almost the same. Therefore, temperature of air sucked from the air conditioning portion 16 is slightly higher than the set temperature (at the time of cooling operation) and slightly lower than the set temperature (at the time of heating operation) and this state is continued for a long time. Therefore, since the compressor operates at low frequency in a state where thermo is ON, a state where COP is low at the time of hunting of temperature and humidity caused by ON/OFF of thermo or at the time of rising of the compressor is not generated, and temperature and humidity are comfortable and uniform in the entire building 2 with saved energy.

Especially at the time of cooling operation in summer, in the air conditioning portion 16, the thermo-ON state with small temperature difference is continued for a long time, the compressor (not shown) is continuously operated. Therefore, surface temperature of the evaporator, i.e., evaporation temperature becomes equal to or lower than the dew-point temperature of the sucked air, moisture of the sucked air is condensed in the evaporator, an amount of dehumidification to be removed is increased by the long time operation, the absolute humidity of the blown-out air is lowered continuously for a long time, absolute humidity of conditioned air is also lowered, and relative humidity in the air conditioning duct, the room and the space there the conditioned air flows is also lowered.

For example, when outdoor temperature is about 35° C. and relative humidity is about 40% and cooling operation is carried out and room temperature is set temperature of 25° C. and a situation is stable, temperature gradient in the ventilation passage and outdoor air of about 30° C. which exchanges heat with indoor air join up with each other with respect to average temperature of 25° C. in the room and the space. According to this, sucked air temperature of the air conditioning unit 10 becomes about 26° C., and if set temperature of the air conditioning portion 16 is 22 to 24° C. which is lower than the sucked air temperature of 26° C. by about 2 to 4 K, the air conditioning portion 16 continues for a long time in the thermo-ON state at a small temperature difference, the compressor (not shown) is operated continuously at low frequency, the amount of eliminated dehumidification is increased, and relative humidity of the air conditioning duct, the room and the space through which conditioned air having low absolute humidity flows is lowered to 40% or less.

Normally, when the cooling operation of the air conditioner is carried out, in condensed water which is condensed in the evaporator when thermo is ON, the compressor stops when the thermo is turned OFF, and if the evaporation temperature rises, the condensed water again evaporates by the sucked air, the absolute humidity of the blown-out air rises, and absolute humidity of the air becomes extremely uncomfortable high, but in the duct type air conditioning ventilation system 1, the frequency of the thermo-OFF state is reduced, and the above-described conditioned air does not occur easily.

Even if the ability of the air conditioning portion 16 is determined as described above, variation in the air conditioning load caused by the outdoor temperature, e.g., temperature in rainy season is not so high, but when humidity is extremely high (temperature is 27° C. and absolute humidity is 80% or higher), if the cooling operation of the air conditioning portion 16 is carried out, since sensible heat ability of a general air conditioner is high, only temperature is lowered relatively fast and thermo is turned OFF, the amount of dehumidification to be eliminated is small, absolute humidity of the conditioned air is not lowered, absolute humidity in the air conditioning duct, the room and the space through which conditioned air flows is not lowered, only temperature is lowered and absolute humidity rises on the contrary in some cases.

In such a case, the operation mode of the air conditioning portion 16 is brought into the re-heat dehumidification operation, the heat exchanger 91 is brought into an evaporator in which low temperature and low pressure refrigerant flows, and the heat exchanger 92 functions as a reheater through which intermediate temperature and intermediate pressure refrigerant flow. Therefore, temperature of the blown-out air is equal to or higher than temperature of sucked air and absolute humidity of the blown-out air becomes low, the blown-out air is blown out from the outlet 87, temperature is not lowered and the absolute humidity is lowered.

According to this, re-heat dehumidification thermo-ON state of the air conditioning portion 16 continues for a long time, and the compressor (not shown) is operated continuously. Therefore, surface temperature, i.e., evaporation temperature of the heat exchanger 91 (evaporator) becomes equal to or lower than the dew-point temperature of the sucked air, moisture of the sucked air is condensed on the heat exchanger 91 (evaporator), the amount of dehumidification to be eliminated is increased by the long time operation, absolute humidity of the blown-out air is lowered continuously for a long time, absolute humidity of the conditioned air is also lowered, absolute humidity in the air conditioning duct, the room and the space through which the conditioned air flows is also lowered.

Although the heat pump type heat exchanger 92 (reheater) through which refrigerant flows is employed in this embodiment, a heat exchanger through which generated hot water flows using fuel battery as a heat source may be employed as the reheater.

As described above, amounts of dust, bacteria, moisture and the like are small in conditioned air which passes through the air conditioning duct and condensation is less prone to occur in the air conditioning duct. Therefore, even if operation is carried out for a long time, a possibility that moisture, mold spore and the like adhere to deposited dust and the like and mold and the like propagate is low. However, when non-woven fabric such as polypropylene exists on the inner surface in the air conditioning duct, the non-woven fabric has air permeability and moisture permeability, dust, moisture, mold spore and the like are adhered to the heat resistant material inside of the non-woven fabric, and mold propagates in some cases.

Further, when the heat resistant material is glass wool, if moisture enters a clearance of fiber by surface tension or capillary action, even if the glass wool dries, fibers are adhered to each other, a large amount of air which is necessary for function of heat resistance cannot be stored, and heat resistance function is deteriorated. Therefore, if condensation once occurs in the duct, condensation easily occurs.

Further, the non-woven fabric has a large surface roughness (convexo-concave of surface), when a lot of dusts are included in passing air for some reason, the dusts get caught on the non-woven fabric, and the dusts are prone to be deposited.

Further, when cleaning is carried out using a machine in which a brash rotates in the air conditioning duct, the brash gets caught on convexo-concave of the surface of the non-woven fabric, and there is a possibility that the non-woven fabric is damaged.

In such a case, on the air conditioning ducts 30, 31, 32, 33 and 34, inside of the heat resistant material 101 such as glass wool, the internal covering material 102 such as polypropylene film, flexible polyvinyl chloride film and PET film which is air permeability and moisture permeability with respect to polyester non-woven fabric having small surface roughness (convexo-concave of surface) and thickness of about 0.1 mm is used on the inner surface of the duct through which conditioned air passes. According to this, dust, moisture and the mold spore do not enter the glass wool from the inner surface of the duct, mold and the like are less prone to propagate, dust and the like are less prone to be deposited on the surface, and moisture is not included. Therefore, mold and the like are less prone to propagate, dust, mold, bacteria, unusual smell and the like in the duct are less prone to enter the building 2, and it is possible to realize healthy and comfortable space.

In this embodiment, the exhaust duct B 55, the air supply duct A 57, the air supply duct B 61 and the exhaust duct C 68 also use ducts which are similar to the air conditioning ducts 30, 31, 32, 33 and 34. Concerning the air supply duct B 61, dust and mold spore are prevented from entering by passage of the outdoor air cleaning filter 58, and since collection efficiency is not 100%, and heat is entirely exchanged with indoor air in the heat exchanging element 63, condensation is suppressed, but in severe winter or severe season, since possibility of condensation is high, if ducts which are similar to the air conditioning ducts 30, 31, 32, 33 and 34 are used, a risk that mold or the like propagates in the duct is reduced, and dust, mold, bacteria, unusual smell and the like in the duct are less prone to enter the building 2. Concerning the air supply duct A 57, if ducts which are similar to the air conditioning ducts 30, 31, 32, 33 and 34 are used, dust, mold spore, moisture and the like are less prone to adhere to the inner side of at least the air supply duct A 57, proceeding of contamination becomes slow, and condensation caused by contact with outdoor air in the outdoor air supply hood 56 is also reduced. Concerning the exhaust duct B 55, if ducts which are similar to the air conditioning ducts 30, 31, 32, 33 and 34 are used, dust, mold spore, moisture and the like are less prone to adhere to the inner side of at least the exhaust duct B 55, proceeding of contamination becomes slow, dust, mold spore, moisture and the like are easily discharged out from the outdoor exhaust hood A 54, and condensation caused by contact with outdoor air in the outdoor exhaust hood A 54 is also reduced. Concerning the exhaust duct C 68, if ducts which are similar to the air conditioning ducts 30, 31, 32, 33 and 34 are used, dust, mold spore, moisture and the like are less prone to adhere to the inner side of at least the exhaust duct C 68, proceeding of contamination becomes slow, dust, mold spore, moisture and the like are easily discharged out from the outdoor exhaust hood C 69, and condensation caused by contact with outdoor air in the outdoor exhaust hood C 69 is also reduced.

If temperature of the room temperature controller 120 is set by the temperature setting portion 125 and the duct type air conditioning ventilation system 1 is operated, the air conditioning portion 16, the plurality of air-blowing portions 13, the air purification system 80 and the heat insulating sash 50 are appropriately controlled and operated by the air conditioning unit controller 110, but its contents become as follows.

Temperature, humidity and dust concentration of conditioned air of the mixing portion 85 in the air conditioning unit 10 are detected by the temperature sensor 111 of the air conditioning unit controller 110, the humidity sensor 112 which detects humidity of the air and, the duct sensor 113 which detects mass concentration of dust in the air. Temperature of air (air in which return air from the room and the space and introduced outdoor air are mixed in the entrance hall 11) is detected by through temperature sensor 121 of the room temperature controller 120, the humidity sensor 122 which detects humidity of the air, and the duct sensor 123 which detects mass concentration of dust in the air, data is sent to the control portions 114 and 124, and the data is sent from the control portion 124 to the control portion 114 through the signal line 150.

Temperature data which is set by the temperature setting portion 125 of the room temperature controller 120 is sent to the control portion 124, and the data is sent from the control portion 124 to the control portion 114 through the signal line 150.

In the control portion 114, temperature detected by the temperature sensor 121 and temperature which is determined (set) by the temperature setting portion 125 are compared with each other, the operation mode of the air conditioning portion 16 is set to any one of the cooling operation and the heating operation. If the cooling operation is set, humidity detected by the humidity sensor 122 is compared with a threshold value, and if the humidity is lower than the threshold value, the operation is determined as the cooling operation, and if the humidity is higher than the threshold value, the operation is determined as the reheating dehumidification operation.

Further, in the control portion 114, average temperature of the room and the space is estimated from temperature of air sucked from the return air port 44 detected by the temperature sensor 121, average temperature of air in the air conditioning duct is estimated from temperature of the conditioned air of the mixing portion 85 detected by the temperature sensor 111, set temperature of the air conditioning portion 16 and blast air volume of the air-blowing portion 13 are determined such that the average temperature of the room and the space becomes equal to the set temperature and such that the average temperature of the room and the space becomes equal to average temperature of air around the air conditioning duct and such that this average temperature becomes equal to average temperature of air in the air conditioning duct within about 5 K at the time of the cooling operation and within about 10 K at the time of the heating operation. Signals of the previously determined operation mode (cooling/heating/reheating dehumidification) of the air conditioning portion 16, the set temperature of the air conditioning portion 16 and the blast air volume of the air-blowing portion 13 are sent to the control portion 130 of the air conditioning portion 16 through the signal line 151, and signals are sent to the control portions 140 of the plurality of air-blowing portions 13 through the signal line 153.

The blowing air volume of the air-blowing portion 13 is determined in a range of 100 $m^3$/h to 300 $m^3$/h under such conditions that when an air conditioning portion 16 in which a floor area of a building is about 100 $m^2$ and a ceiling height thereof is 2.5 m and cooling ability is 4 kW and conditioned air volume at the time of cooling operation is 600 $m^3$/h is installed, ten air-blowing portions 13 each having blowing air volume of about 100 $m^3$/h at weak air volume and 300 $m^3$h at the maximum air volume are installed, a total blowing air volume of the ten air-blowing portions 13 is 1000 $m^3$/h to 2000 $m^3$/h, this is greater than conditioned air volume of the air conditioning portion 16, and 30 to 60% air volume of the total air volume is equal to conditioned air volume (weak wind mode) of the air conditioning portion 16. During operation of the duct type air conditioning ventilation system 1, blowing air volume is not set to 0, and control is performed such that wind speed of the conditioned air in the air conditioning ducts 30, 31, 32, 33 and 34 having the inner diameters of 150 mm is always in a range of 1.6 to 4.7 m/s.

Generally, evaporation speed Y (kg/$m^2$s) of water caused by movement of air on water surface becomes $Y=K\cdot V(Xw-Xa)$ based on saturated vapor amount Xw (kg/$m^3$) of water surface, water vapor amount Xa (kg/$m^3$) of air on water surface, and moving speed V (m/s) of air on water surface, and this is proportional to the moving speed. When this is applied to the air conditioning ducts 30, 31, 32, 33 and 34, moisture condensed on inner peripheral surface of the air conditioning duct is proportional to wind speed of conditioned air and its evaporation amount is increased. Therefore, in the duct type air conditioning ventilation system 1, even when condensation occurs in the air conditioning duct, since it is evaporated as soon as possible, the blowing air volume is not brought into 0, and conditioned air is always kept flowing.

The control portion 130 of the air conditioning portion 16 which receives signals of the operation mode and the set temperature determines operation states of the compressor and the like of the air conditioning portion 16 together with data of suction temperature from the suction temperature sensor 133, the control portion 130 instructs the air blower control portion 131 and the louver control portion 132 about the number of rotations of the air blower 90 and the angle of the louver 94, and sends a signal to the control portion 135 of the air conditioning outdoor machine 14 through the signal line 152.

The control portion 135 of the air conditioning outdoor machine 14 which receives a similar signal instructs the compressor control portion 136 and the outdoor air blower control portion 137 about the number of rotations of the compressor and the number of rotations of the outdoor air blower.

Further, the control portion 114 compares the concentration of dust detected by the duct sensor 123 and the threshold value, and if the concentration is lower than the threshold value, the control portion 114 determines to stop the air purification system 80, and if the concentration is higher than the threshold value, the control portion 114 determines to operate the air purification system 80, the control portion 114 sends a signal to the control portion 160 of the air purification system 80 through the signal line 154, and the control portion 160 which receives the signal instructs to stop or operate the electric dust collector control portion 161.

Concerning ventilation air volume of the heat exchanging ventilation unit 50, ventilation air volume for 24 hours which corresponds to a size of the building 2 is set by ventilation air volume (not shown) of the air conditioning unit controller 110, the control portion 114 sends a signal to the control portion 165 of the heat exchanging ventilation unit 50 through the signal line 155, and the control portion 165 instructs the motor control portion 166 about the number of rotations of the fan which corresponds to its air volume, but when humidity and concentration of dust detected by the humidity sensor 122 and the duct sensor 123 are largely greater than the threshold value, the ventilation air volume is determined such that it temporarily becomes greater than the ventilation air volume for 24 hours, and the control portion 165 instructs the motor control portion 166 about the number of rotations.

For example, it is possible to employ such a configuration that the control portion 114 and a control portion (not shown) of the ceiling embedded type ventilation fan 67 are connected to each other through the signal line, and when humidity and concentration of dust detected by the humidity sensor 122 and the duct sensor 123 are largely greater than the threshold values, determination may be made to operate the ceiling embedded type ventilation fan 67, and a signal may be sent to the control portion (not shown) of the ceiling embedded type ventilation fan 67 from the control portion 114.

In this case, since air-supply/exhaust balance of the entire building 2 is lost by exhaust of the ceiling embedded type ventilation fan 67, the number of rotations is increased by the introduction fan (not shown) which introduces outdoor air of the heat exchanging ventilation unit 50, and a signal may be sent to the control portion 165 from the control portion 114 such that the air-supply/exhaust balance is kept.

For example, when outdoor temperature in summer is about 35° C. and relative humidity is about 40% and temperature detected by the temperature sensor 121 of the room temperature controller 120 is 28° C. and temperature set by the temperature setting portion 125 is 25° C., operation mode of the air conditioning portion 16 is once determined as a cooling mode by the control portion 114, and humidity detected by the humidity sensor 122 is 50%, since this is lower than the threshold value of 70%, it is determined that the operation is cooling operation.

The control portion 114 estimates average temperature of the room and the space is 27° C. from the temperature 28° C. detected by the temperature sensor 121, and estimates average temperature of air in the air conditioning duct is 25° C. from the average temperature 25° C. detected by the temperature sensor 111, the control portion 114 sets the average temperature 27° C. of the room and the space is set to the average temperature 27° C. of air around the air conditioning duct so that the average temperature 27° C. in the room and the space becomes equal to the set temperature 25° C., the control portion 114 determines the set temperature of the air conditioning portion 16 as 22° C. such that temperature becomes average temperature of air in the air conditioning duct of 22° C. to 27° C. within 5 K at the time of cooling operation (average temperature in the air conditioning duct at that time is 25° C.), the control portion 114 determines that blowing air volume of the air-blowing portion 13 is 200 $m^3$/h, the control portion 114 sends a signal to the control portion 130 of the air conditioning portion 16 through the signal line 151, and the control portion 114 sends a signal to the control portions 140 of the plurality of air-blowing portions 13 through the signal line 153.

The control portion 130 of the air conditioning portion 16 which receives signals of operation mode "cooling" and set temperature "22° C." instructs that the operation state of the compressor of the air conditioning portion 16, e.g., the number of rotations of the air blower 90 is 900 r/min together with data of sucked temperature "28° C." from the suction temperature sensor 133, an angle of the louver 94 is changed from horizontal to downwardly 45°, the compressor is operated at intermediate frequency of 52 Hz, and the number of rotations of the outdoor air blower air volume is 600 r/min.

The control portions 140 of the plurality of air-blowing portions 13 which received signals of the blowing air volume [200 $m^3$/h] instruct the respective motor control portions 141 that the number of rotations of the motors are 1200 r/min.

For example, when outdoor temperature in rainy season is about 27° C. and relative humidity is about 80% and temperature detected by the temperature sensor 121 of the room temperature controller 120 is 24° C. and temperature which is set by the temperature setting portion 125 is 22° C., the control portion 114 once determines that the operation mode of the air conditioning portion 16 is as the cooling mode, and when humidity detected by the humidity sensor 122 is 80%, since this is higher than the threshold value 70%, it is determined that the operation is reheating dehumidification operation.

The control portion 114 estimates that the average temperature in the room and the space is 23° C. from temperature 24° C. detected by the temperature sensor 121, and estimates that the average temperature of air in the air conditioning duct is 20° C. from temperature 20° C. detected by the temperature sensor 111, the control portion 114 determines that the average temperature 23° C. in the room and the space is average temperature 23° C. of air around the air conditioning duct such that the average temperature 23° C. in the room and the space becomes equal to the set temperature 22° C., the control portion 114 determines that the set temperature of the air conditioning portion 16 is 22° C. such that temperature at the time of the cooling operation becomes equal to average temperature of air in the air conditioning duct of 18° C. to 23° C. within 5 K at the time of the cooling operation (average temperature in the air conditioning duct at this time is 20° C.), the control portion 114 determines that blowing air volume of the air-blowing portion 13 is 150 $m^3$/h, the control portion 114 sends a signal to the control portion 130 of the air conditioning portion 16 through the signal line 151, and the control portion 114 sends a signal to the control portions 140 of the plurality of air-blowing portions 13 through the signal line 153.

The control portion 130 of the air conditioning portion 16 which received signals of the operation mode "reheating dehumidification" and set temperature "22° C." instructs that the operation state of the compressor of the air conditioning portion 16 together with data of suction temperature "23° C." from the suction temperature sensor 133, e.g., the number of rotations of the air blower 90 is 600 r/min for example, the angle of the louver 94 is changed from horizontal to 45° downward, the compressor is operated at 32 Hz at low frequency, and the number of rotations of the outdoor air blower is 600 r/min.

The control portions 140 of the plurality of air-blowing portions 13 which received the signal of the blowing air volume "150 $m^3$/h" instruct the motor control portions 141 that the number of rotations of the motor is 900 r/min.

For example, when outdoor temperature in winter is about 7° C. and temperature detected by the temperature sensor 121 of the room temperature controller 120 is 16° C. and temperature which is set by the temperature setting portion 125 is 20° C., the control portion 114 determines that the operation mode of the air conditioning portion 16 is heating mode.

The control portion 114 estimates that average temperature of the room and the space is 17° C. from temperature 16° C. detected by the temperature sensor 121, estimates that average temperature of air in the air conditioning duct is 25° C. from temperature 25° C. detected by the temperature sensor 111, the control portion 114 determines that average temperature 17° C. of the room and the space is average temperature 17° C. of air around the air conditioning duct such that the average temperature 17° C. in the room and the space becomes equal to set temperature 20° C., the control portion 114 determines the set temperature of the air conditioning portion 16 is 22° C. such that temperature becomes average temperature of air in the air conditioning duct of 17° C. to 27° C. within 10 K at the time of heating operation (average temperature in the air conditioning duct at that time is 25° C.), the control portion 114 determines that the set temperature of the air conditioning portion 16 is 22° C., the control portion 114 determines blowing air volume of the air-blowing portion 13 is 200 $m^3$/h, the control portion 114 sends a signal to the control portion 130 of the air conditioning portion 16 through the signal line 151, and sends a signal to the control portions 140 of the plurality of air-blowing portions 13 through a signal line 153.

The control portion 130 of the air conditioning portion 16 which received the signals of the operation mode "heating" and set temperature "22° C." instructs that the operation state of the compressor of the air conditioning portion 16, e.g., the number of rotations of the air blower 90 is 900 r/min together with data of suction temperature "16° C." from the suction temperature sensor 133, the angle of the louver 94 is changed from horizontal to 60° C. downward, the compressor is operated at intermediate frequency of 52 Hz, and the number of rotations of the outdoor air blower is 900 r/min.

The control portions 140 of the plurality of air-blowing portions 13 which received the signals of the blowing air volume "200 $m^3$/h" instruct the motor control portion 141 that the number of rotations of the motor is 1200 r/min.

Thereafter also, at certain timing, the control portion 114 determines set temperature of the air conditioning portion 16 such that average temperature of the room and the space becomes equal to the set temperature and the average temperature of air around the air conditioning duct becomes equal to average temperature of air in the air conditioning duct within about 5 K at the time of the cooling operation and within about 10 K at the time of the heating operation, and the control portion 114 determines the blowing air volume of the air-blowing portion 13, sends a signal to the control portion 130 of the air conditioning portion 16 through the signal line 151, and sends a signal to the control portions 140 of the plurality of air-blowing portions 13 through the signal line 153.

Tother with data of the suction temperature from the suction temperature sensor 133, the control portion 130 of the air conditioning portion 16 which received signals of the operation mode and the set temperature instructs about the operation state of the compressor of the air conditioning portion 16, the number of rotations of the air blower, the angle of the louver, the operation frequency of the compressor, the number of rotations of the outdoor air blower and the like.

The control portions 140 of the plurality of air-blowing portions 13 which received the signal of the blowing air volume instruct the motor control portion 141 about the number of rotations of the motor.

The above-described operations are repeated until the operation is stopped by the air conditioning unit controller 110.

Although the number of rotations of the air-blowing portion 13 is controlled during operation, the air-blowing portion 13 is not stopped, the sirocco fan keeps rotating, and the air-blowing portion 13 keeps blowing air to the air conditioning ducts 30, 31, 32, 33 and 34. This is because that this is effective to keep moving the air in the air conditioning ducts 30, 31, 32, 33 and 34, to sweep dust on the surface away from the outlet, to evaporate moisture, and to uniform the temperature and humidity in the building 2 including inside and outside of the air conditioning ducts 30, 31, 32, 33 and 34.

It is preferable that operation by the air conditioning unit controller 110 is basically continued for 24 hours and 365 days except when the operation is stopped due to maintenance or when persons do not stay for a long time. Since the air-blowing portion 13 is rotated by high efficient DC motor (not shown), energy is originally saved, and consumed power is further reduced in proportion to the number of rotations, but the compressor of the air conditioning outdoor machine 14 occupies a large rate of consumed power. Therefore, even if the air-blowing portion 13 is continuously operated, if an air conditioning load becomes large due to outdoor temperature or insolation, since the compressor operates at low frequency or stops when the situation is stable, even if the compressor keeps operating, the consumed power of the system is extremely small but it is extremely effective to prevent dust, mold and moisture from being adhered or deposited on the air conditioning ducts 30, 31, 32, 33 and 34.

Further, when "setting average temperature in the room and the space to the set temperature", and "bringing average temperature of air around the air conditioning duct to the average temperature of air in the air conditioning duct within about 5 K at the time of the cooling operation and within about 10 K at the time of the heating operation" are incompatible, control is normally performed such that priority is given to "bringing average temperature in the room and the space to the set temperature", but when the operation is started and the air conditioning load is large, it is possible to change the operation mode to a mode which gives priority to "bringing average temperature of air around the air conditioning duct to air in the air conditioning duct within about 5 K at the time of the cooling operation and within about 10 K at the time of the heating operation" by an operation which is hidden in the air conditioning unit controller 110 (for example, set temperature is brought into minimum temperature or maximum temperature when the operation is started).

However, basically, amounts of moisture, dust, bacteria and the like in air which passes through the air conditioning duct are largely smaller than those of a normal duct type air conditioning ventilation system, a building 2 of high airtight and high heat resistance is provided with an air conditioning portion 16 having appropriate ability, a total blowing air volume of the air-blowing portion 13 is set greater than conditioned air volume of the air conditioning portion 16, and air volume of 30 to 60% of total blowing air volume is set as conditioned air volume (weak wind mode) of the air conditioning portion 16. According to this, when a situation is stable when operation is carried out for a long time, humidity of blown-out air of the air conditioning portion 16 becomes almost equal to temperature of sucked air, average temperature of air in the air conditioning duct becomes almost equal to average temperature of air around the air conditioning duct. Therefore, dust and the like are less prone to be deposited and moisture is less prone to be included and thus, mold and the like are less prone to propagate.

In this embodiment, the attic space 6 and the under floor space 7 which are heat resistant spaces are also provided with the outlets 25 and 26 and conditioned air is blown by the plurality of air-blowing portions 13. A purpose thereof is of course to condition the space where the air conditioning ducts 30, 31, 32, 33 and 34 spread to prevent the condensation inside and outside the air conditioning duct. All of the heat resistant spaces where the air conditioning ducts 30, 31, 32, 33 and 34 spread may be provided with the outlets for avoiding risks of change in the air conditioning load and deterioration with time of the heat resistant material and the like. For example, the vertical shaft 35 may be provided with the outlet.

Another reason why the outlet is provided in a space where a person does not stay almost at all is that if the entire building 2 is air-conditioned, temperature in the entire building 2 becomes uniform temperature having a small temperature difference between rooms and spaces, heat does not move, and energy is saved for maintaining the comfortable space on the contrary. Especially, the attic space 6 and the under floor space 7 are large spaces which face the outer wall of the building 2 and therefore, heat resistance is enhanced and energy of air conditioning is saved for the building 2.

In this embodiment, the air conditioning portion 16 is described as a so-called air conditioning indoor unit in which the heat exchangers 91 and 92 and the air blower 90 are accommodated in the integrated casing, the air-blowing portion 13 is described as the air blower, and the air conditioning unit 10 is described as an air conditioning room, i.e., a relatively compact room of about 3 $m^2$ having four sides surrounded by heat resistant walls. However, the air conditioning unit 10 may be a casing surrounded by metal plate, only a heat exchanger is provided in the casing as the air conditioning portion 16, a plurality of air blowers may be provided as the air-blowing portion 13, a portion of air sucked into the air conditioning unit 10 passes through the heat exchanger by a plurality of air blowers and according to this, a portion of air sucked into the air conditioning unit 10 is made as bypass air which does not pass through the heat exchanger as the blown-out air, bypass air and blown-out air may be mixed in the casing as conditioned air, and the conditioned air may be blows to the room and the space. In this case also, it is preferable that the air conditioning portion 16, the plurality of air-blowing portions 13 and the air purification system 80 have such sizes and structures that maintenance such as cleaning and operation can easily be carried out.

One of examples of this embodiment is such a rational system that when a floor area of the building 2 is about 100 $m^2$ a ceiling height is 2.5 m, in order to air condition and ventilate the room and the space at uniform temperature with saved energy, if a total air volume which is sent to the room and the space is 1500 $m^3$/h, circulating times are 6 times/h, processed air volume of the air purification system 80 is also 1500 $m^3$/h, circulating times are 6 times/h, and by blowing large air volume for air conditioning and ventilation of the entire building 2, air cleaning of the entire building 2 including the air conditioning duct can also be carried out.

Generally, since an electric dust collecting type system has smaller ventilation resistance as compared with the HEPA filter type system, there are merits that consumed power and driving noise of the air-blowing portion 13 are small, clogging is less prone to occur, and life is long, but there are demerits that transient dust collecting efficiency is low, and by-product such as ozone is generated.

On the other hand, generally, the HEPA filter type system has demerits that it has large ventilation resistance, consumed power and operation noise of the air-blowing portion 13 are large, clogging is prone to occur, and life is short, but there are merits that transient dust collecting efficiency is high, it is easy to collect material having smaller particle diameters for a short time, and by-product such as ozone is not generated.

In this embodiment, if operations are carried out for a long time, the systems of any types can eliminate particles such as dust, mold spore. Therefore, the types may be selected based on kind and degree of harmful material to be eliminated, a shape of a machine, a shape of the air conditioning unit 10, wind speed of air in the air conditioning unit 10, frequency of maintenance, and point treated by a user as important.

Especially in the case of the HEPA filter type, if large air volume passes, it is necessary to largely enhance the performance (P-Q and the like) of the air-blowing portion 13, and noise is also increased, but in this embodiment, since air is sent by the plurality of air-blowing portions 13, e.g., ten air-blowing portions 13, and the air volume is circulated in the building 2. Therefore, enhancement of performance of the air-blowing portion 13 per one portion is moderated. In order to increase the air volume per one air-blowing portion 13, it is easy to enhance by increasing the number of rotations of the DC motor of each of the air-blowing portions 13, and the increasing amount of the consumed power is smaller as compared with the AC motor, and it is possible to increase the total air volume and to clean air in the building 2 rationally and efficiently while saving energy.

If the air conditioning unit 10 is brought into such a size of the return air port 44 that passing wind speed of the HEPA filter becomes 1 m/s or less, the increase in noise can be suppressed, but if there is enough space in the building 2, it is relatively easy increase the air conditioning unit 10.

In this embodiment, the return air port filter 75 (efficiency is 80% or more) and the air purification system 80 (it can collect particles of 0.3 μm) are placed in this order from upstream of wind passage in the air conditioning unit 10 toward the air conditioning ducts 30, 31, 32, 33 and 34, and the air-blowing portion filter 77 (efficiency is 30%) is provided immediately before the air conditioning ducts 30, 31, 32, 33 and 34, the filter portion and the air purification system 80 efficiently clean air which passes through the circulation passage, and if maintenance is easy, the air purification system 80 may be provided in the middle of the circulation passage, concerning the order of placement of the filter portion and the air purification system 80 in the circulation passage and the air conditioning unit 10, if ones having large collectable particles which can be collected or one having low collecting efficiency are placed upstream and one having small collectable particles or one having high collecting efficiency are placed downstream, pressure losses of the filter portion and the air purification system are not abruptly increased and as a result, frequency of maintenance such as cleaning can be reduced while saving energy. If the filter portion is provided immediately before the air conditioning ducts 30, 31, 32, 33 and 34 like the air-blowing portion filter 77 of the embodiment, even if leakage exists in a wind passage or other filter portion or air purification device 80 existing upstream, it is effective to minimize the entrance of dust and the like.

For example, even if efficiency of the air-blowing portion filter 77 is lowered, its position is kept as it is, pre-return air port filter (efficiency is 30%) is additionally provided upstream of the return air port filter 75, the pre-return air port filter (efficiency is 30%), the return air port filter 75 (efficiency is 80% or more), the air purification device 80 (particles of 0.3 μm can also be collected), and the air-blowing portion filter (efficiency is low) are provided and this is rational.

Here, the prefilter of the air purification device 80 is not included in the above-described filter, but including this, configuration and order of the rational filter portion are preferable.

A reason why the air conditioning portion filter 76 (efficiency is low) is not placed in this order is that there is a wind passage which can bypass the air conditioning portion filter 76 among the circulation passages, and even if the efficiency of the air conditioning portion filter 76 is enhanced, the number of air volumes which bypass is only increased.

In this embodiment, the air conditioning portion 16 having the reheating dehumidification function and the mixing portion 85 are provided substantially immediately before the air-blowing portions 13 which are entrances of the air conditioning ducts 30, 31, 32, 33 and 34 in the airtightly thermal insulated air conditioning unit 10. Therefore, absolute humidity is lowered, conditioned air having appropriate temperature and humidity can be blown to the air conditioning ducts 30, 31, 32, 33 and 34 directly, and it is possible to prevent the condensation in the air conditioning ducts 30, 31, 32, 33 and 34.

From the above-described configuration, conditioned air within about 5 K at the time of the cooling operation and within about 10 K at the time of the heating operation is blown into the duct with large air volume with respect to temperature of air around the air conditioning ducts 30, 31, 32, 33 and 34 creased by the air conditioning unit 10, air is blown out from the outlets 22, 23, 24, 25 and 26 of the room A 20, the room B 21, the entrance hall 11, the attic space (heat resistant space) 6, the under floor space (heat resistant space) 7, and air conditioning is carried out in the rooms and the upper and lower heat resistant spaces in the high airtight and high heat resistant building 2. Therefore, temperature and humidity easily become comfortable and uniform in the building 2 including the heat resistant space having large air conditioning load such as insolation load. Since the air conditioning ducts 30, 31, 32, 33 and 34 pass through the heat resistant space, condensation inside and outside of the duct at the time of cooling operation and the condensation in the duct at the time of heating operation are less prone to occur.

The circulation passage (air conditioning unit 10) where conditioned air flows and returns is provided with a plurality of filter portions (return air port filter 75 the air conditioning portion filter 76 and the air-blowing portion filter 77), air in the building 2 is cleaned, the outdoor air introduction passage is provided with the heat exchanging ventilation unit 50 and the outdoor air cleaning filter 58, introduced outdoor air is cleaned, and a portion of conditioned air which is air-conditioned in the room and the heat resistant space, i.e., dirty zone (toilet 51, lavatory and the like) is discharged to outdoor through the air conditioning ducts 30, 31, 32, 33 and 34. According to this, cleaned outdoor air is introduced, air in the building 2 which is contaminated with dust and moisture is discharged out and, in this state, the air is circulated in the building 2, and is cleaned. The cleaned air flows through the air conditioning ducts 30, 31, 32, 33 and 34 and therefore, the dust and the like are less prone to be deposited in the dust.

By providing the ceiling embedded type ventilation fan 67 which discharges air to outdoor, in the building 2, air in the bathroom 66 and the kitchen which generates moisture by bathing or cooking other than moisture generated by a human is not accumulated in the building 2, and the moisture is not included in the conditioned air. Therefore, the moisture does not flow into the air conditioning ducts 30, 31, 32, 33 and 34.

From these reasons, since dust, moisture, condensation water and the like are not deposited and accumulated in the air conditioning ducts 30, 31, 32, 33 and 34, mold is less prone to propagate, smell caused by miscellaneous bacteria is less prone to be generated, dust, mold, bacteria, unusual smell and the like in the 30, 31, 32, 33 and 34 are less prone to enter the building 2, and healthy and comfortable space can be realized. Even if the building is used for a long time, maintenance such as exchange and cleaning of the air conditioning ducts 30, 31, 32, 33 and 34 is unnecessary, and healthy and comfortable air conditioning and ventilation can always be carried out in the building 2.

The building 2 having high airtight and high heat resistance is formed to conform to a roof heat resistance specification and basic heat resistance specification, the attic space 6 which is the uppermost portion of the building and which is easily influenced by insolation and outdoor air temperature is formed as a heat resistant space, the under floor space 7 which is influence by temperature of the ground surface which is the lowermost portion of the building 2 and which has easily rising humidity, and all of spaces facing the outer skin of the building 2 is the heat resistant space which is entirely air conditioned together with air conditioning of the room which is side heat resistant space of the building 2. Therefore, temperature and humidity in the building 2 become more uniform including insides and outsides of the air conditioning ducts 30, 31, 32, 33 and 34, and condensation inside and outside of the duct at the time of cooling operation and condensation in the duct at the time of heating operation are less prone to be generated.

A portion of air sucked from the return air port (suction portion) 44 is sucked into the air conditioning portion 16 by the air-blowing portion 13 of the air conditioning unit 10, and the portion of the air is air-conditioned and blown out. The portion of the air sucked from the suction portion is not sucked into the air conditioning portion 16, and joins up with the previously described blown-out air in the mixing portion 85 and is mixed, air volume, set temperature of the air conditioning portion 16 and air volume of the air-blowing portion 13 are adjusted, and it is possible to stably create a large air volume of conditioned air of within about 5 K at the time of the cooling operation and within about 10 K at the time of the heating operation with respect to temperature of air around the air conditioning ducts 30, 31, 32, 33 and 34. Since the conditioned air passes through the air conditioning ducts 30, 31, 32, 33 and 34, condensation is less prone to occur in the air conditioning duct.

Air volume of the air-blowing portion 13 is largely great due to air volume of the air conditioning portion 16. Therefore, temperature of sucked air in the air conditioning portion 16 is slightly higher (at the time of cooling operation) and slight lower (at the time of heating operation) than the set temperature for a long time stably. Thus, especially at the time of cooling operation in summer, thermo-ON state with small temperature difference is continued for a long time in the air conditioning portion 16, and the compressor is continuously operated at low frequency. Therefore, surface temperature, i.e., evaporation temperature of the evaporator becomes equal to or lower than the dew-point temperature of the sucked air, moisture in the sucked air condenses in the evaporator, the dehumidification amount to be eliminated is increased by long time operation, absolute temperature of the blown-out air is continuously lowered for a long time, absolute humidity of the conditioned air is also lowered, relative humidity in the room and the space in the air conditioning ducts 30, 31, 32, 33 and 34 where the conditioned air flows is also lowered, and condensation is less prone to occur on the air conditioning ducts 30, 31, 32, 33 and 34.

According to this system, by driving the compressor and the like of the air conditioning portion 16, air volume of the air-blowing portion 13 whose running cost per unit air volume is largely lower than the air volume of the air conditioning portion 16 whose running cost per unit air volume is increased, conditioned air is created, and the air passes through the air conditioning ducts 30, 31, 32, 33 and 34. Therefore, energy is saved. For example, to create conditioned air of 1200 $m^3$/h for blowing wind to an entire house only by an air conditioner (air conditioning portion) of cooling ability of 4 kW, COP4, at least two air conditioners of at least 600 $m^3$/h are necessary, and if ability is controlled and thermo is not turned OFF, it takes about 30 to 40 Yen. However, to create conditioned air by an air conditioner (air conditioning portion) and an air blower (air-blowing portion), one air conditioner and six air blowers of 200 $m^3$/h are necessary, and if ability is controlled and thermo is not turned OFF, the air blower requires a DC motor and consumed power of one air blower is about 5 W/h. Therefore, it is estimated that it takes only about 20 Yen/h with one air conditioner. Generally, a fan of the air conditioned is a tangential fan, static pressure is low, and air cannot be blow by a duct, and, although it depends upon room layout of the house, it is difficult to blow conditioned air to the entire house using two air conditioners, and more air conditioners are necessary in an actual case, and running cost is further increased. On the other hand, since the air blower uses an axial fan, static pressure is high, and this is suitable for blowing wind by a duct. Therefore, conditioned air can be created by one air conditioner, and running cost is reduced.

Further, at heat exchanger time of reheating dehumidification operation, the one heat exchanger 91 functions as the evaporator through which low temperature and low pressure refrigerant flows, and the other heat exchanger 92 functions as reheater through which intermediate temperature and intermediate pressure flows. Therefore, the air becomes blown-out air having temperature which is equal to or greater than sucked air and having low absolute humidity, the air is blown out from the outlet 87, the reheating dehumidification thermo-ON state of the air conditioning portion 16 continues for a long time, and the compressor continuously operates. Therefore, surface temperature of the evaporator, i.e., evaporation temperature becomes equal to or lower than the dew-point temperature of the sucked air, moisture in the sucked air occurs condensation on the evaporator, and if it is operated for a long time, the amount of dehumidification to be eliminated is increased, absolute humidity of the blown-out air is lowered continuously for a long time, absolute humidity of the conditioned air is also lowered, absolute humidity in the air conditioning ducts 30, 31, 32, 33 and 34, the room and the space where the conditioned air flows is also lowered, and when temperature is intermediate and humidity is high such as rainy season, condensation does not occur on the air conditioning ducts 30, 31, 32, 33 and 34 easily.

Further, the circulation passage (air conditioning unit 10) is provided with the HEPA filter type or electric dust collecting type air purification device 80, particles such as mold spore included in the conditioned air are eliminated. Therefore, mold is less prone to propagate in the air conditioning ducts 30, 31, 32, 33 and 34 through which conditioned air passes.

Inner surfaces of the air conditioning ducts 30, 31, 32, 33 and 34 through which conditioned air flow have air permeability and moisture permeability, does not have non-woven fabric having large convexo-concave surfaces, but have non-air permeability and non-moisture permeability polypropylene film, flexible polyvinyl chloride film and PET film having small surface roughness (convexo-concave surface). Therefore, dust, moisture, mold spore and the like do not enter the glass wool from the surface, and mold and the like are less prone to propagate. Further, dust and the like are less prone to be deposited on the surface. Since moisture is also not included, mold and the like are less prone to propagate. Dust, mold, bacteria, unusual smell and the like in the air conditioning ducts 30, 31, 32, 33 and 34 do not enter the building 2 easily, and it is possible to realize a healthy and comfortable space.

Further, average temperature in the room and the space automatically becomes equal to the set temperature, and temperature thereof becomes equal to the average temperature of air in the air conditioning ducts 30, 31, 32, 33 and 34 within about 5 K at the time of the cooling operation and within about 10 K at the time of the heating operation with respect to the average temperature of air around the air conditioning ducts 30, 31, 32, 33 and 34. Therefore, it is possible to suppress the condensation inside and outside the air conditioning duct while keeping the space at temperature which is set by a user, and even when disturbance occurs or air conditioning load is varied, mold and the like are reliably less prone to propagate.

Second Embodiment

FIG. 6 is a construction diagram of a sound absorbing heat resistant duct in a system in a second embodiment of the present invention.

For example, when a room B 21 is used as a bedroom and noise from the outlet 23 of the room B 21 (noise of flow of conditioned air and propagation of noise from air conditioning unit 10) is large and a trouble such as sleepless comes about, if a sound absorbing heat resistant duct 170 having high sound absorbing properties and high heat resistance is provided between an air conditioning duct 31 and an outlet 23, the noise can be reduced.

One of flanges of a joint 171 is connected to the air conditioning duct 31, and the other flange is connected to another flexible sound absorbing heat resistant duct 170 having an inner diameter of 150 mm and a length of 3 m. When they are connected to each other, nails are driven from four portions of a periphery of the duct and then, an airtight thermal insulation tape is pasted using a sufficient tab for sticking.

The other sound absorbing heat resistant duct 170 is connected to a flange 172 of an outlet 23 in the similarly manner as that described above.

A mounting flange 175 of an outlet 23 is inserted into a mounting hole 174 formed in a ceiling 173 of the room B 21, and the mounting flange 175 of the outlet 23 is mounted on the ceiling 173 through a screw or the like.

When the sound absorbing heat resistant duct 170 is cleaned or exchanged, a size of the mounting hole 174 is 400 mm×400 mm rectangular, and a size of the outlet 23 is 450 mm×450 mm rectangular which can close the outlet 23, so that the outlet 23 is detached from the ceiling 173, the sound absorbing heat resistant duct 170 is pulled out toward the room B 21 from the mounting hole 174 and the sound absorbing heat resistant duct 170 can be cleaned and exchanged. It is preferable that a position of the mounting hole 174 is determined and the sound absorbing heat resistant duct 170 is accommodated such that it coils around the mounting hole 174 on the back side of the ceiling 173 so that the joint 171 can be constructed manually.

FIG. 7 is the sectional view of the sound absorbing heat resistant duct.

The sound absorbing heat resistant duct 170 is a flexible duct having high sound absorbing properties and high heat resistance and wet resistance. An inner diameter of the sound absorbing heat resistant duct 170 is 150 mm.

The duct is composed of, from outer side, flexible external covering material external covering material 100 such as polypropylene sheet having a thickness of about 0.08 mm, a heat resistant material 101 such as glass wool having a thickness of about 25 mm and density of about 24 kg/m$^3$, an internal covering material 102 such as polypropylene film, flexible polyvinyl chloride film and PET film which is non-air permeability and non-moisture permeability and has small surface roughness (convexo-concave surface) and a thickness of about 0.1 mm, an air layer 180 having a thickness of 10 to 50 mm, a sound absorbing material 181 made of aluminum fiber having high sound absorbing properties, high wet resistance and a thickness of 1 to 2 mm, and a wind passage 103 through which conditioned air and the like pass. A molding core material (not shown) such as polypropylene resin is provided between the inner side of the internal covering material 102 and the outer side of the sound absorbing material 181 so that even if the sound absorbing heat resistant duct 170 is bent, the entire duct does not buckle, and a sectional area of the inside air layer 180 and the wind passage 103 can be secured.

The sound absorbing heat resistant duct 170 is configured such that the glass wool which is the heat resistant material 101 is provided with the internal covering material 102 such as the polypropylene film, the flexible polyvinyl chloride film and the PET film which are non-air permeability and non-moisture permeability and which has small surface roughness (convexo-concave surface) such that dust, moisture, mold spore and the like do not enter the glass wool. Therefore, mold and the like are less prone to propagate.

On the inner side of the sound absorbing heat resistant duct 170, there are the air layer 180 and the sound absorbing material 181 made of aluminum fiber, and they are in contact with the wind passage 103. Therefore, noise of flowing fluid such as conditioned air and nose generated by the air conditioning unit 10 and the like are absorbed by the air layer 180 and the porous sound absorbing material 181. Since the sound absorbing material 181 itself is made of aluminum fiber, the sound absorbing material 181 is excellent in wet resistance, and even if condensation occurs on the sound absorbing material 181, the sound absorbing material 181 does not include moisture, and even if moisture enters the inside air layer 180, the moisture is prevented from entering further by the internal covering material 102, and the moisture returns to the wind passage 103 by weight and evaporation on the contrary. Since the sound absorbing material 181 functions as a so-called filter, a possibility that dust and the like enter the air layer 180 is low, and the dust is only adhered to the surface of the air layer 180 at most. Therefore, cleaning is carried out to eliminate dust and the like which are adhered to the surface of the sound absorbing material 181 of the sound absorbing heat resistant duct 170 from the mounting hole 174 about once a year or periodically, and if it is deteriorated over time, the sound absorbing heat resistant duct 170 is detached and exchanged. Concerning cleaning, there is no non-woven fabric on the inner surface of the duct, and the duct is made of metal sound absorbing material, it has strength, and even if it is cleaned using a brush, the duct is less prone to be damaged.

In this embodiment, the glass wool having the thickness of about 25 mm and density of about 24 kg/m$^3$ is used as the heat resistant material 101 of the sound absorbing heat resistant duct 170. However, when an outer diameter of the duct is increased and it is difficult to secure a space through which the duct passes in the heat resistant space of the building 2, it is possible to employ glass wool having the density of the heat resistant material of 100 kg/m$^3$ or more and the thickness of 10 mm or less, thereby securing the duct space. In this case, since the heat resistance of the duct is slightly lowered, it is preferable to enhance the air conditioning ability by strengthening the heat resistance of the heat resistant space through which the duct passes, by passing the duct through the heat resistant space which is separated away from the outer skin of the building 2, or by increasing the number of outlets 25, 26 of the heat resistant space.

A thickness 10 to 50 mm of an air layer 181 is determined based on frequency or amplitude of noise which is desired to be absorbed.

According to this, the sound absorbing heat resistant duct 170 having the aluminum fiber sound absorbing material 181 having high sound absorbing properties and high wet resistance is provided between the outlet 23 and the air conditioning duct 31 on an inner surface of the duct on which conditioned air flows such that the sound absorbing heat resistant duct 170 can be exchanged by the mounting hole 174. Therefore, noise from the outlet 23 of a room which requires quietness such as a bedroom can be reduced, and only dust and the like are adhered to the surface of the sound absorbing material at most. Hence, mold and the like is less prone to propagate as compared with a sound absorbing material such as glass wool, and when heat resistance is nor reduced and when it is necessary to periodically clean the duct or to exchange the duct by any possibility, it is possible to easily clean the inside of the duct or exchange the duct from the mounting hole 174.

INDUSTRIAL APPLICABILITY

The present invention provides a system capable of air conditioning and ventilating an entire inner side of a building and capable of maintaining a healthy and comfortable space while keeping the inner side of the duct clean, and the system can be applied to an air conditioning and ventilation of a building not only to a general house, but also to a hotel, an office, an industrial facility, a hospital, a factory, and a researching facility, only if the building employs the system to convey conditioned air and ventilated air using the duct.

EXPLANATION OF SYMBOLS

1 duct type air conditioning ventilation system
2 building
3 roof
4 basis
5 heat resistant sash
6 attic space (heat resistant space)
7 under floor space (heat resistant space)
10 air conditioning unit
11 entrance hall
12 stair landing
13 air-blowing portion
14 air conditioning outdoor machine
15 electric wire
16 air conditioning portion
20 room A
21 room B
22 outlet
23 outlet
24 outlet
25 outlet
26 outlet
30 air conditioning duct
31 air conditioning duct
32 air conditioning duct
33 air conditioning duct
34 air conditioning duct
35 vertical shaft
40 exhaust port
41 exhaust port
42 exhaust port
43 exhaust port
44 return air port (suction portion)
50 heat exchanging ventilation unit
51 toilet
52 ventilation exhaust port
53 exhaust duct A
54 outdoor exhaust hood A
55 exhaust duct B
56 outdoor air supply hood
57 air supply duct A
58 outdoor air cleaning filter
59 filter box
60 ventilation air supply port
61 air supply duct B
63 heat exchanging element
64 element prefilter
65 louver
66 bathroom
67 ceiling embedded type ventilation fan
68 exhaust duct C
69 outdoor exhaust hood C
70 louver
75 return air port filter (filter portion)
76 air conditioning portion filter (filter portion)
77 air-blowing portion filter (filter portion)
80 air purification system
85 mixing portion
86 suction port
87 outlet
88 suction port
90 air blower
91 heat exchanger
92 heat exchanger
93 drain pan
94 louver
100 external covering material
101 heat resistant material
102 internal covering material
103 wind passage
110 air conditioning unit controller
111 temperature sensor
112 humidity sensor
113 duct sensor
114 control portion
120 room temperature controller
121 temperature sensor
122 humidity sensor
123 duct sensor
124 control portion
125 temperature setting portion

130 control portion
131 air blower control portion
132 louver control portion
133 suction temperature sensor
135 control portion
136 compressor control portion
137 outdoor air blower control portion
140 control portion
141 motor control portion
150 signal line
151 signal line
152 signal line
153 signal line
154 signal line
155 signal line
160 control portion
161 electric dust collector control portion
165 control portion
166 motor control portion
170 sound absorbing heat resistant duct
171 joint
172 flange
173 ceiling
174 mounting hole
175 mounting flange
180 air layer
181 sound absorbing material

The invention claimed is:

1. A duct type air conditioning ventilation system for use in at least a room and a heat insulation space, the room and the heat insulation space being located in a high airtight and high heat insulation building, the duct type air condition system comprising:

an air conditioning unit provided in the building, an outlet provided for the room and the heat insulation space, the air conditioning unit and the outlet being connected to each other through an air conditioning duct, the air conditioning duct is formed in the heat insulation space, conditioned air which is cleaned by the air conditioning unit is created, the cleaned conditioned air flows from the air conditioning unit to the outlet, and a wind passage through which the cleaned conditioned air flows from the air conditioning unit to the outlet and returns to the air conditioning unit is a circulation passage, wherein a suction portion, an air conditioning portion, a mixing portion and a plurality of air-blowing portions are provided in this order in the air conditioning unit from an upstream side toward a downstream side of the circulation passage, the suction portion includes a filter portion A, the air conditioning portion includes a filter portion B, and the plurality of air-blowing portions include a filter portion C, air sucked from the suction portion through the circulation passage is cleaned by the filter portion A, a portion of the air sucked from the suction portion is air-conditioned and cleaned by the air conditioning portion and the filter portion B, blown-out air which is blown out from the air conditioning portion and a remaining portion of the portion of the air sucked from the suction portion are mixed, by the plurality of air-blowing portions, with each other in the mixing portion located upstream of the filter portion C, conditioned air within 5 K at the time of a cooling operation and within 10 K at the time of a heating operation are created with respect to temperature of air around the air conditioning duct, the conditioned air is further cleaned by the plurality of air-blowing portions and the filter portion C, the cleaned conditioned air is blown into the air conditioning duct toward the outlet, thereby air-conditioning and air-cleaning the room and the heat insulation space through the circulation passage, the air conditioning ventilation system further includes an outdoor air introduction passage for introducing outdoor air into the circulation passage or the air conditioning unit from outdoor, the outdoor air introduction passage is provided with an introduction fan and a filter, and the introduced outdoor air is cleaned, the air conditioning ventilation system further includes an indoor air exhausting passage for discharging air in the building to the outdoor from any one of the circulation passage, the room which is not provided with the outlet, and the heat insulation space which is not provided with the outlet, and the indoor air exhausting passage is provided with an exhaust fan, and at least one of a portion of air in the circulation passage and a portion of the air which is accumulated in the building is discharged to the outdoor.

2. The duct type air conditioning ventilation system according to claim 1, wherein the high airtight and high heat insulation building is of roof heat insulation specification and basis heat insulation specification, the heat insulation space is an attic space and an under floor space, a total air volume of the plurality of air-blowing portions is larger than that of the air conditioning portion, and the air volume of the air-blowing portion is not zero.

3. The duct type air conditioning ventilation system according to claim 1, wherein the air conditioning portion has a reheating dehumidification function.

4. The duct type air conditioning ventilation system according to claim 1, wherein the circulation passage or the air conditioning unit is provided with an HEPA filter type air purification system or an electric dust collecting type air purification system.

5. The duct type air conditioning ventilation system according to claim 1, wherein an inner surface of the air conditioning duct where the conditioned air flows is provided with any one of a polypropylene film, a flexible polyvinyl chloride film, and a PET film.

6. The duct type air conditioning ventilation system according to claim 1, further comprising a temperature sensor for detecting temperature of the room or the heat insulation space, and a temperature setting portion for setting the temperature, wherein the duct type air conditioning ventilation system further comprises a temperature sensor for detecting temperature of the mixing portion, and the duct type air conditioning ventilation system further comprises a control portion for controlling the air conditioning portion and the air-blowing portion from detected values of the two temperature sensors and set temperature of the temperature setting portion.

7. The duct type air conditioning ventilation system according to claim 1, further comprising a heat insulation duct located between the air conditioning duct and the outlet, wherein the heat insulation duct is provided with an aluminum fiber sound absorbing material on an inner surface of the duct where the conditioned air flows.

* * * * *